US006712349B2

(12) United States Patent
Watanabe

(10) Patent No.: US 6,712,349 B2
(45) Date of Patent: Mar. 30, 2004

(54) SHEET FOLDER WITH TURNOVER AND PRESSING DEVICE

(75) Inventor: Tetsuji Watanabe, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 50 days.

(21) Appl. No.: 09/953,927

(22) Filed: Sep. 18, 2001

(65) Prior Publication Data

US 2002/0033569 A1 Mar. 21, 2002

(30) Foreign Application Priority Data

Sep. 19, 2000 (JP) ..... 2000-284086
Sep. 27, 2000 (JP) ..... 2000-294777

(51) Int. Cl.[7] ..... B42C 1/12

(52) U.S. Cl. ..... 270/37; 370/58.07; 370/58.08; 399/410; 493/444; 493/384; 412/18

(58) Field of Search ..... 370/37, 32, 38, 370/45, 58.07, 58.08; 493/444, 445, 435, 384; 399/410; 412/18

(56) References Cited

U.S. PATENT DOCUMENTS 3,632,104 A * 1/1972 Dufour ..... 493/444
4,640,611 A * 2/1987 Ohdake et al. ..... 355/77
5,382,011 A * 1/1995 Tani ..... 270/37
6,022,011 A * 2/2000 Hirose ..... 270/37
6,217,016 B1 * 4/2001 Honmochi et al. ..... 270/37
6,354,059 B1 * 3/2002 Yoshie et al. ..... 53/117

FOREIGN PATENT DOCUMENTS

JP 7-157180 * 6/1995
JP 10-279163 10/1998
JP 11-193162 7/1999
JP 2000-177919 * 6/2000

* cited by examiner

*Primary Examiner*—Patrick Mackey
(74) *Attorney, Agent, or Firm*—Oblon, Spivak, McClelland, Maier & Neustadt, P.C.

(57) ABSTRACT

A sheet processing apparatus comprising a center-stapling device, a center-folding device, and a stacking tray for stacking a discharged sheet or sheet bundle, staples at the center of a sheet bundle conveyer from a sheet output apparatus with the center-stapling device, folds the stapled sheet bundle into two with the center-folding device, and discharges the sheet bundle to stack on the stacking tray. Folding rollers discharge the sheet bundle folded into two by the center-folding device from the side folding into two. In this state, an opening/closing end fence orients a discharging direction of the sheet bundle folded into two downward in vertical direction, turns over the sheet bundle, and stacks the sheet bundle on a tilted lower side stacking tray.

94 Claims, 26 Drawing Sheets

SHEET FOLDER WITH TURNOVER AND PRESSING DEVICE

FIELD OF THE INVENTION

The present invention relates to a sheet processing apparatus, a sheet processing system, and a sheet processing method for processing sheets such as stapling sheets, punching sheets, and folding sheets, and relates to the sheet processing apparatus, the sheet processing system, and the sheet processing method which are independent as a sheet processing apparatus, are integrated into a sheet output apparatus such as a copying machine, a printer, a facsimile, or a printing press, or are attachingly installed on a sheet output apparatus for realizing individual features such as stapling, punching, and folding.

BACKGROUND OF THE INVENTION

Conventionally, different types of sheet processing apparatuses for stapling, punching for filing, and folding after stapling sheets on which images are recorded with an image forming apparatus such as a copying machine, a printer or a facsimile have been proposed.

As Japanese Patent Laid-open No. Hei 10-279163 and Hei 11-193162 disclose, sheet processing apparatuses having features of stapling and folding multiple sheets at the center have been well known. These sheet processing apparatuses are constituted in such a manner that they staple a sheet bundle at the center in a conveying direction for example, then fold the sheet bundle into two at the center in conveying direction, and discharge sheet folded at the center on a stacking tray with discharging rollers.

This type of sheet processing apparatus with a simple book binding feature (sheet post-processing apparatus), which staples a sheet bundle at the center and folds the sheet bundle into two, stacks a sheet bundle folded into two on a tray in such a manner that a part where the sheet bundle is stapled and folded faces toward a sheet conveying direction, or, in other words, the part where the sheet bundle is stapled and folded is placed on a farther side from a main unit of the sheet post-processing apparatus when the sheet post-processing apparatus staples a sheet bundle at the center, and discharges and stacks the sheet bundle folded into two. When the sheet bundle stapled and folded at the center is stacked in such a manner that the part stapled and folded at the center is placed on the farther side from the main unit of sheet post-processing apparatus, both ends of the sheet bundle, which are not folded, bulge.

Though the tray is generally tilted upward on the downstream side of sheet discharging direction, as the number of stacked sheet bundles increases, the both ends of sheet bundle, which are not folded, bulge, a volume on a side of the sheet bundle, which is generally lower, increases, and a sheet bundle stacking face on the downstream side of sheet discharging direction becomes lower.

When a sheet bundle is discharged on the sheet bundle stacking face in the state tiled downward on the front side, the sheet bundle falls down from the sheet bundle stacking face, and is not stacked on the stacking tray properly. To avoid this problem, it is required to limit the stacked amount. When the stacked amount is limited in this way, the image forming is suspended at a processed number of sheets corresponding to that stacked amount, leading to a decrease of the processing efficiency. Since the amount of bulge depends on the thickness, the number, or the flexibility of a sheet bundle to be folded into two, even if the stacked number is limited, a sheet bundle may not be stacked on the tray.

When the tray is placed horizontally in a conventional apparatus, the tendency of tilting downward on the front side increases, and the stacked amount is decreased accordingly. To avoid this problem, a sheet pressing arm, which has a fulcrum on an upper side of a sheet discharging opening, and presses a sheet bundle at a free end, is provided.

However, with this type of sheet pressing arm, an area to be pressed is limited by a relationship between length of the arm and an installed position of the arm, and the stacked amount of sheets does not increase largely.

Also, since a contact with a top face of sheet bundles is close to a point contact or a line contact, the sheet bundles are not pressed sufficiently, and the bundles are stacked while they are in bulged state. Thus the stacked amount of sheet bundles is limited.

Also, a conventional example is provided with a dedicated stacking tray for stacking sheet bundles which are stapled at the center and then folded into two. Also a dedicated slope for this tray (such as horizontal slope) is set and fixed. Providing this type of dedicated tray increases the complexity of mechanism of the entire sheet post-processing apparatus, and it is not avoidable that the cost increases accordingly. A space for installing a dedicated tray is also required, thereby increasing the entire size of apparatus, resulting in never meeting a requirement of space saving and downsizing.

As shown in FIG. 36, when a pair of rollers 451 and 452 discharge a sheet bundle 700 in such a manner that a front end F on a folded side faces the a stacking tray 301 whose downstream side in a sheet discharging direction tilts upward after the sheet bundle is stapled and folded at the center, the position of a bulged part depends on the size of sheet bundle 700, the stacked states are not aligned depending on where the bulged part is generated on the sheet bundle 700, the stacked state also becomes unstable in this case, and an incident that the sheet bundle 700 falls from the stacking tray 301 occurs. Thus, the stacked amount does not increase.

The present invention is made in view of these problems, and the purpose is to provide a sheet processing apparatus stacking more sheet bundles which are stapled at the center and folded into two.

An alternative purpose of the present invention is to provide a sheet processing apparatus whose sheet discharging tray is shared by standard sheets which are not folded into two.

Another alternative purpose of the present invention is to provide a sheet processing apparatus which stacks sheet bundles folded into two without increasing the size of apparatus.

Another alternative purpose of the present invention is to provide an image forming system comprising this type of sheet processing apparatus and an image forming apparatus.

Another alternative purpose of the present invention is to provide a sheet processing method which stacks more sheet bundles stapled at the center and folded into two.

SUMMARY OF THE INVENTION

To attain the purposes described before, the present invention provides a sheet processing apparatus comprising a center-stapling mean for stapling the center of a sheet bundle conveyed from a sheet output apparatus, a center-folding mean for folding the stapled sheet bundle into two, a discharging mean for discharging the sheet bundle folded into two in such a manner that the side folded into two is discharged first, a turning-over mean for turning over a sheet bundle discharged from the discharging mean so that the side folded at the center is oriented to upstream side in sheet conveying direction, and a stacking tray for stacking a sheet or sheet bundle discharged from the discharging mean and turned over by the turning over mean.

The turning-over mean comprises a guide plate for forcing the front side of a sheet bundle discharged from the discharging mean orient downward for discharging. The guide plate is urged toward a closing direction with a predetermined force, and the maximum opening of guide plate is set to a predetermined angle. The guide plate is closed, and retracts to or beyond a face flush with a rear end fence with which a rear end side of a sheet bundle is in contact for a standard discharging without folding a sheet bundle into two, thereby eliminating an interference when the sheet stacking tray moves up/down. It is preferable to provide a detecting mean for detecting an open/closed state of the guide plate.

The turning-over mean may comprise a mean for changing an angle of the stacking tray in such a manner that the angle of stacking tray is steeper than that for the standard discharging without folding a sheet bundle into two. In this state, the angle changing mean changes an angle of the stacking tray more than a angle sufficient for generating a slide in a downward direction of the front end on the side folded into two of a discharged bundle when the front end of sheet bundle comes in contact with the stacking tray or a top sheet face of stacked sheet bundles. The angle changing mean may change only a part of the stacking tray. When the angle changing mean is constituted in such a manner that the angle of only a part of the stacking tray is changed, an auxiliary tray, which rises from the stacking tray with a predetermined position on the stacking tray as a fulcrum, provides this constitution. It is preferable to set the predetermined position in a range of 40 mm 10 mm from the rear end fence. The mean for rising the auxiliary tray is constituted with a cam mean, which operates according to the position of stacking tray.

A sheet processing apparatus is provided with a lifting mean for lifting up/down the stacking tray, and a stacking tray driving control mean for controlling drive of the lifting mean, the stacking tray driving control mean moves the stacking tray from a standard discharging position for standard discharging without folding a sheet bundle into two to a predetermined lower position, and operates the cam mean to raise the auxiliary tray when a mode for discharging a sheet bundle folded into two is set. A lock mean for locking a position of an auxiliary tray when the auxiliary tray raises is provided. It is necessary that the lock mean is released when the stacking tray moves up from the predetermined position. The auxiliary tray is constituted in such a manner that it does not rise due to a self-weight of sheets when the stacking tray moves to the predetermined lower position for standard discharging without folding sheet bundles into two.

For the turning-over, the discharging mean is constituted with a pair of discharging rollers, and the peripheral speed of an upper side roller of the discharging rollers is higher than the peripheral speed of a lower side roller. For this constitution, a driving control mean for driving the pair of rollers is introduced as the turning-over mean.

The present invention also provides a sheet processing apparatus comprising a center-stapling mean for stapling the center of a sheet bundle conveyed from a sheet output apparatus, a center-folding mean for folding the stapled sheet bundle into two, a discharging mean for discharging the sheet bundle folded into two in such a manner that the side folded into two is discharged first, a stacking tray for stacking a sheet or sheet bundle discharged from the discharging mean, a lifting mean for lifting the stacking tray, a stacking tray driving control mean for controlling drive of the lifting mean, and moving the stacking tray from a standard discharging position for discharging without folding a sheet bundle into two to a predetermined lower position shorter than a conveying distance of a folded sheet bundle when a mode for discharging a sheet bundle folded into two is set, and a guide mean for deflecting downward the front end of sheet bundle discharged from the discharging mean, the guide mean makes the front end folded into two of the sheet bundle come in contact with the stacking tray or a top sheet face of stacked sheet bundles, and the discharging mean maintains the discharging operation in this state to turn over the sheet bundle, thereby stacking the sheet bundles on the sheet upper side stacking tray.

When the front end of side folded into two of a sheet bundle comes in contact with the stacking tray or a top sheet face of stacked sheet bundles, a pushing member, which pushes a part at least closer to the rear end than to the front end, pushes out a non-stapled side toward the downstream side in discharging direction may be provided to turn over the sheet bundle surely.

The present invention provides a sheet processing apparatus comprising a center-stapling mean for stapling the center of a sheet bundle conveyed from a sheet output apparatus, a center-folding mean for folding the sheet bundle into two, a discharging mean for discharging the stapled and folded sheet bundle, a stacking tray for stacking a sheet or sheet bundle discharged from the discharging mean, an aligning mean for aligning the sheet bundle on the upstream side in a discharging direction of the stacking tray, and a pressing mean for pressing the sheet bundles stacked on the stacking tray on the aligned end.

The aligning mean aligns the sheet or sheet bundle on the folded side of sheet or sheet bundle. The aligning mean comprises the stacking tray tilted in such a manner that the downstream side is higher than the upstream side in a conveying direction, and a rear end fence which supports the stacking tray for lifting up/down, and ends of the sheet bundles discharged on the stacking tray are in contact with. The folded side of sheet bundle folded into two is discharged first to align the sheet bundles on the folded side, and a turning-over mean is provided to turn over the sheet bundle in such a manner that the folded side is positioned on a side of the aligning mean.

The pressing mean comprises a pressing member, which comes in contact with a top face of a sheet bundle, and a driving mean for protruding and retracting the pressing member from a contact face of the rear end fence with which the aligned ends of sheet bundles come in contact, for example. The protruding/retracting action of pressing member is linear. Or, the action may not be linear, and the pressing member operates in such a manner that the pressing member is protruded at an upward angle to the sheet stacking face of stacking tray, and a downward angle to the sheet stacking face of stacking tray is maintained when the pressing member is fully protruded. The action is inversed when the pressing member is retracting.

The sheet processing apparatus is provided with a lifting mean for lifting the stacking tray, and the lifting mean lifts up the stacking tray while the pressing member is protruded over the sheet bundles placed on the stacking tray, thereby pressing the sheet bundles between the pressing member and the stacking tray to restrain the bulge of sheet bundles. This reduces the volume of sheet bundles when a large number of them are stacked, thereby stacking larger number of them.

A detecting mean for detecting a pressing force for pressing the sheet bundles is provided, and the lifting mean stops a lifting-up action when the detecting mean detects that the pressing force is more than a predetermined value. This allows always pressing the sheet bundle at a constant pressing force. For pressing securely, an angle between a protruding direction of the pressing member and the stacking face of stacking tray is set as:

$$\theta f \geqq \theta t$$

where θf is an angle between the pressing member and the rear end fence (on the sheet discharging side), and θt is an angle between the stacking tray and the rear end fence (on the sheet discharging side) when the lifting mean stops the lifting-up action of stacking tray. This setting prevents the sheet bundles from displacing, and securely presses the sheet bundles even if the stapled side bulges.

An example of the detecting mean comprises an urging member for urging a member for supporting the pressing member in a direction resisting against the lifting-up action of the lifting mean, and a position detecting mean for detecting the position of the supporting member, and detects whether the pressing force is more than the predetermine value or not from a position of the supporting member detected by the position detecting mean.

The discharge of sheet bundle is conducted by the discharging mean while the pressing member is being protruded, the discharging mean discharge the sheet bundle, the sheet is stacked on a top face of the pressing member, and then the driving mean retracts the pressing member inside the rear end fence. After the pressing member retracts, the lifting mean lifts down the stacking tray a predetermined distance. The predetermined distance is set variably according to the stapled sheet number of the sheet bundle.

As the turning-over mean, an angle changing mean, which changes an angle of the stacking tray in such a manner that the angle of stacking tray is steeper than that for the standard discharging without folding into two, is introduced. As the angle changing mean, an auxiliary tray, which rises from the stacking tray with a predetermined position of the stacking tray as a fulcrum is used. The predetermined position is provided in a range of 40 mm 10 mm from the rear end fence, or, in other words, a lower end of sheet stacking face of the stacking tray considering the sizes of sheets which are commonly used such as A4, letter size and legal size. It is desirable that the protruding amount when the pressing member protrudes, is set to a distance from the rear end fence (lower end of the sheet stacking face of stacking tray) to the angle changing position of stacking tray, or, in other words, a distance approximately equivalent to that to the fulcrum of the auxiliary tray. The protruding amount when the pressing member protrudes is set in such a manner that it decreases as the stack number of sheet bundle stacked on the stacking tray increases, or is variable according to stapled number of sheets.

If the pressing member is set to a dimension for pressing a predetermined area set symmetrical about the center of sheet bundle (dimension for pressing a predetermined length orthogonal to the sheet conveying direction), the pressing member provides a secure pressing. Independent multiple pressing members may be provided in positions symmetrical about the center of sheet bundle for simplicity. It is important to press positions symmetrical about the center. Otherwise, the stack state becomes unstable, and the stack amount does not increase.

For the pressing member, coefficient of friction on the top face is set higher than that on the bottom face so as not to displace the position of sheet bundles during the protruding/retracting acting. To attain the same concept, a roller, which is set rotational at least when the pressing member is protruding may be provided at tip of the pressing member.

The present invention provides a sheet processing system comprising the sheet processing apparatus of individual forms of the present invention described before, an image forming apparatus including an image forming mean for forming an image based on an entered image data, and an input mean allowing a user to select at least stapling mode for stapling a sheet bundle at the center, and folding mode for folding a sheet bundle into two at the center, a first controlling mean for controlling individual parts of the sheet processing apparatus, and a second controlling mean for mutually communicating with the first controlling mean, sending control information to the first controlling mean, and controlling individual parts of the image forming apparatus, and the sheet processing apparatus uses the turning-over mean set for the sheet processing apparatus to turn the sheet bundle to stack on the sheet stacking tray when both the stapling mode and the folding mode are set from the image forming apparatus.

The present invention provides a sheet processing system comprising the sheet processing apparatus of individual forms of the present invention described before, an image forming apparatus including an image forming mean for forming an image based on an entered image data, and an input mean allowing a user to select at least stapling mode for stapling a sheet bundle at the center, and folding mode for folding a sheet bundle into two at the center, a first controlling mean for controlling individual parts of the sheet processing apparatus, and a second controlling mean for mutually communicating with the first controlling mean, sending control information to the first controlling mean, and controlling individual parts of the image forming apparatus, the sheet processing system applies a process on a sheet bundle discharged from the image forming apparatus, the sheet processing apparatus lifts down a stacking tray for stacking the discharged sheet bundle to a predetermined position lower than a position where a pressing plate is provided for pressing the sheet bundles stacked on the stacking tray on an aligned end when both the stapling mode and the folding mode are set from the image forming apparatus, uses a turning-over mean to turn over the sheet bundle, and to stack the sheet bundle on the stacking tray, and uses the pressing plate and the stacking tray to press the sheet bundles on a stapled side.

The present invention provides a sheet processing method which folds a sheet bundle stapled at the center of sheets into two at the same center, stacks the sheet bundle on a predetermined stacking tray, and comprises steps of folding the sheet bundle into two at the center, restricting dropping direction of the sheet bundle to a predetermined direction, setting a tilting angle of the stacking tray so that a front end on the folded side of dropped sheet bundle is placed on the lower side of tilted stacking tray, turning over the sheet bundle, and stacking the sheet bundle on the stacking tray.

The present invention provides a sheet processing method for attaining the purpose described before which folds a sheet bundle stapled at the center of sheets into two at the same center, stacks the sheet bundle on a predetermined stacking tray, and comprises steps of folding a sheet bundle into two at the center, turning over the sheet bundle, aligning the sheet bundle on a stapled side, protruding a pressing plate over aligned sheet bundles, lifting up the stacking tray while pressing a top face of the sheet bundles with the pressing plate, applying a predetermined pressing force between the pressing plate and the stacking tray to restrain a bulge of the sheet bundles, and stacking aligned sheet bundles on a stacking tray.

These individual constitutions provide sheet processing apparatuses for stacking larger number of sheet bundles stapled and folded into two at the center. Since a discharge tray for standard sheets which are not folded into two is also applied to this apparatus, the sheet bundles folded into two are stacked without increasing the size.

DESCRIPTION OF PREFERRED EMBODIMENTS

Figure 1:
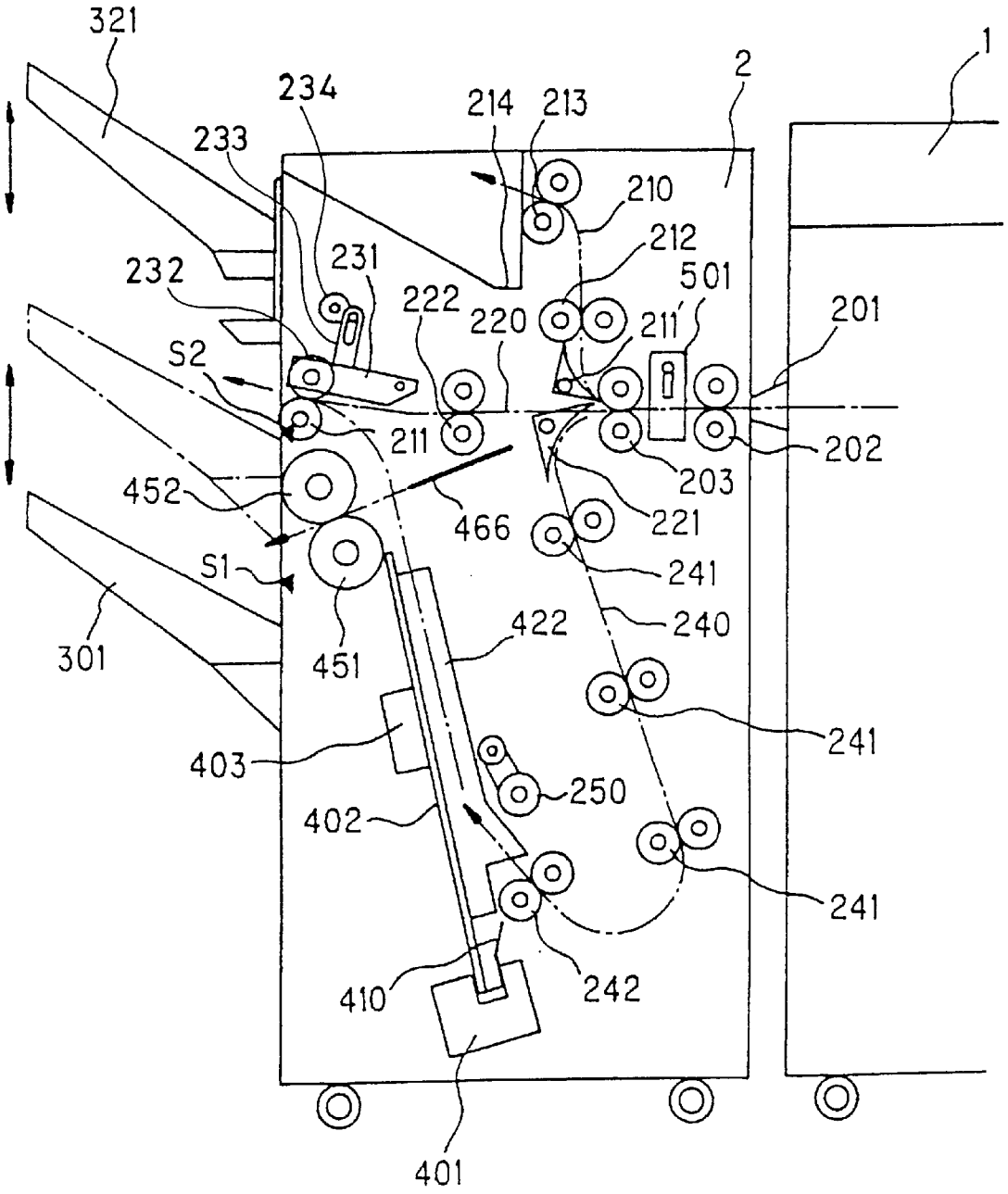
FIG. 1 describes an embodiment of the present invention, and shows a constitution overview of a sheet post-processing apparatus which relates to the present embodiment, and is connected to a copying machine.

The following section describes embodiments of the present embodiment referring to the drawings.

1. Overall Constitution

FIG. 1 shows a constitution overview of a sheet post-processing apparatus connected to a copying machine. The following section describes constitutions and operations of individual parts while referring to the Figure.

A sheet post-processing apparatus 2 is connected to a sheet discharging opening of a copying machine 1. A copied sheet discharged from a main unit of copying machine 1 is conveyed into a main unit of the sheet post-processing apparatus from an entrance guide plate 201 of the sheet post-processing apparatus 2, and is conveyed into the sheet post-processing apparatus 2 by conveying rollers 202 and 203. A known rotary punch 501 is provided on the upstream side of branching pawls 211' and 221. The rotary punch 501 is driven by an instruction for a punching action from the copying machine 1, and punches at predetermined positions (rear end of a sheet) of a sheet bundle.

When non-staple mode is selected on an operation part 12 (refer to FIG. 30) of the main unit of copying machine 1, a sheet passes through the branching pawls 211' and 221 (the branching pawls 211' and 221 are positioned in a direction of a non-staple conveying path 220), and is discharged to and stacked on a lower side stacking tray 301 or an upper side stacking tray 321 by discharging roller 211. In this state, a discharging guide plate 231 is closed, and a discharging roller 232 is in contact with the discharging roller 211.

The lower side stacking tray 301 and the upper side stacking tray 321 are provided in such a manner that they are lifted up/down by independent driving parts which are not shown. The individual stacking trays 301 and 321 can move to a sheet discharging position of the discharging roller 211. According to a selected discharging mode, the lower side stacking tray 301 or the upper side stacking tray 321 moves. Switching between the stacking trays 301 and 321 is available. The sheet post-processing apparatus is provided with an interruption tray 214. When interruption tray discharging mode is selected on the operation part 12 of main unit of copying machine 1, the branching pawl 211 rotates. With this action, a sheet is conveyed toward an interruption tray conveying path 210, and is discharged to and stacked on the interruption tray 214 by discharging rollers 213. Sheet face sensors S1 and S2 for detecting a face of a sheet on the upper side stacking tray 321 or the lower side stacking tray 301 are provided at discharging positions for the discharging roller 211 and a folding roller 451. The amount of stacks are determined by output from the sheet face sensors S1 and S2, and individual positions of the lower side stacking tray 301 and the upper side stacking tray 321. The sheet face sensor S1 corresponds to a sheet face sensor 332 (refer to FIG. 3).

When staple mode is selected on the operation part 12 of main unit of copying machine 1, the branching pawl 221 operates to conveying a sheet into a staple conveying path 240. The sheet is conveyed by conveying rollers 241 toward a staple tray 402 through the staple conveying path 240. Then, the sheet is discharged by staple tray discharging rollers 242, and is stacked on the staple tray 402.

The sheet discharged to the staple tray 402 is individually dropped downward in the staple tray 402 by a hitting roller 250, and pressed to a sheet rear end base fence 410 for aligning a rear end. The sheet is also individually arranged in a crosswise direction of sheet (direction orthogonal to the sheet conveying direction) by a jogger fence 422. The staple tray 402 is used when individual features such as sheet aligning, center-stapling, and center-folding are conducted, and functions as a sheet processing tray.

Figure 14:
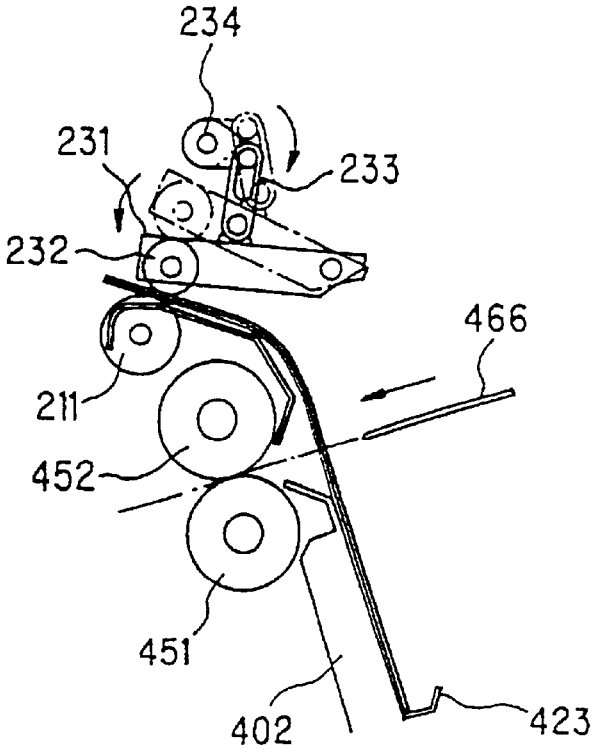
FIG. 14 shows a state where a discharging guide plate is closed to hold a part near a front end of a sheet bundle for starting folding motion.

If end stapling is selected on the operation part 12 during mode selection, the discharging guide plate 231 is opened by a rotation of a cam 234 through a link 233 as enlarged in FIG. 14. When the sheet end stapling is selected, after the jogger fence 422 aligns the last sheet, an end face stapler 401 applies a stapling treatment to one or two locations at predetermined positions on a rear end of a sheet bundle. An ejecting pawl 423 (refer to FIG. 10) integrated with an ejecting belt (suppressed from Figure) lifts the stapled sheet bundle at least as high as the front end reaches the position of discharging roller 211. Then the discharging guide plate 231 enters a closed state through the rotation of cam 234. The sheet bundle is pressed against the discharging roller 211 by the own weight of discharging guide plate 231, and is discharged toward the lower stacking tray 301 or the upper stacking tray 321 by the discharging roller 211.

1.1 Sheet Stacking Tray

Figure 2A:
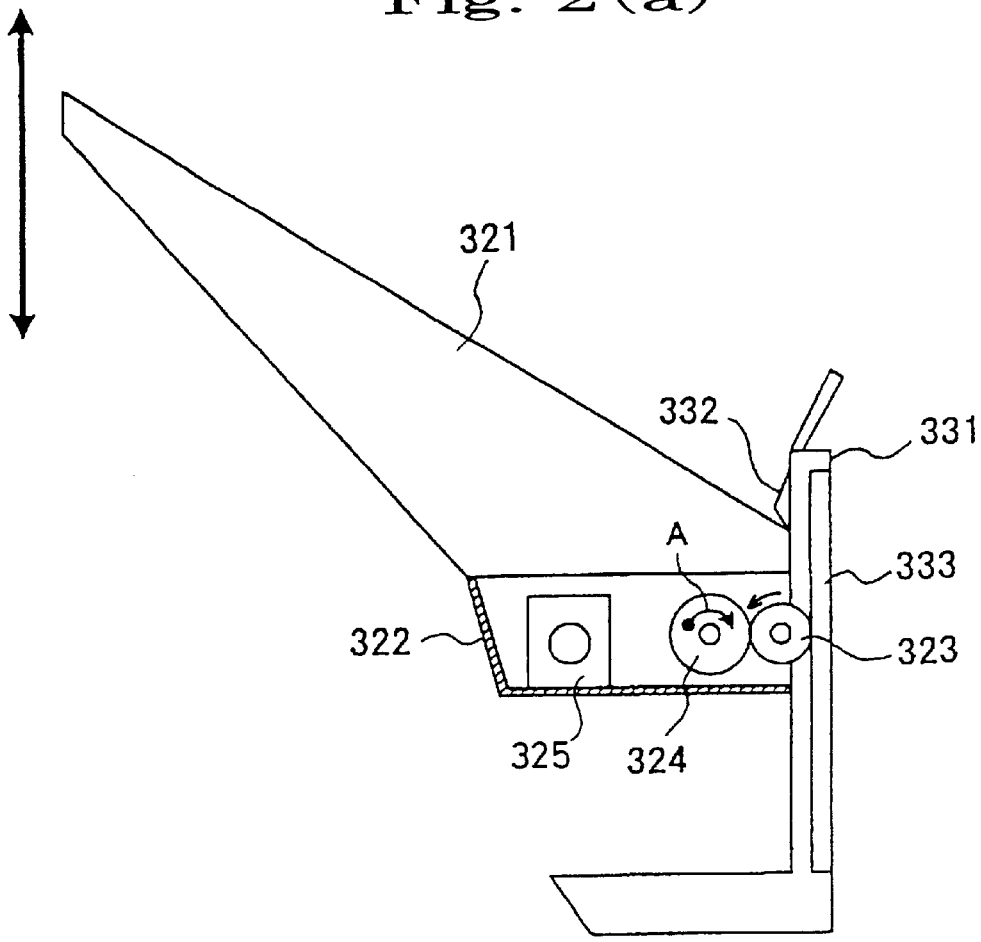
FIGS. 2(*a*) and (*b*) show a lifting mechanism for an upper side stacking tray of the sheet post-processing apparatus relating to the present invention, and (*a*) is a side view, and (*b*) is a plan view.
Figure 2B:
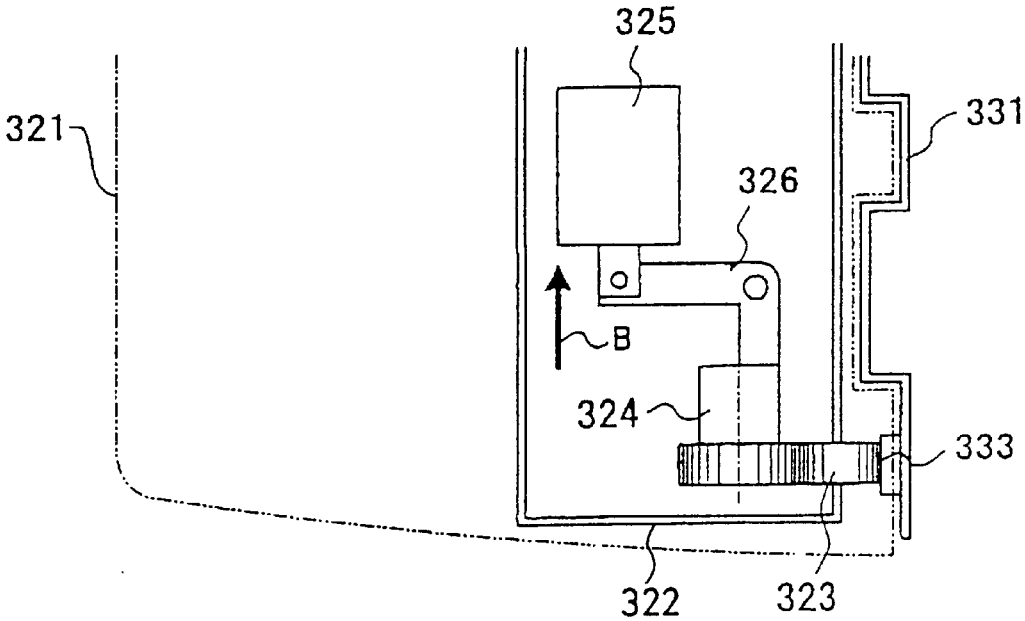
Figure 3:
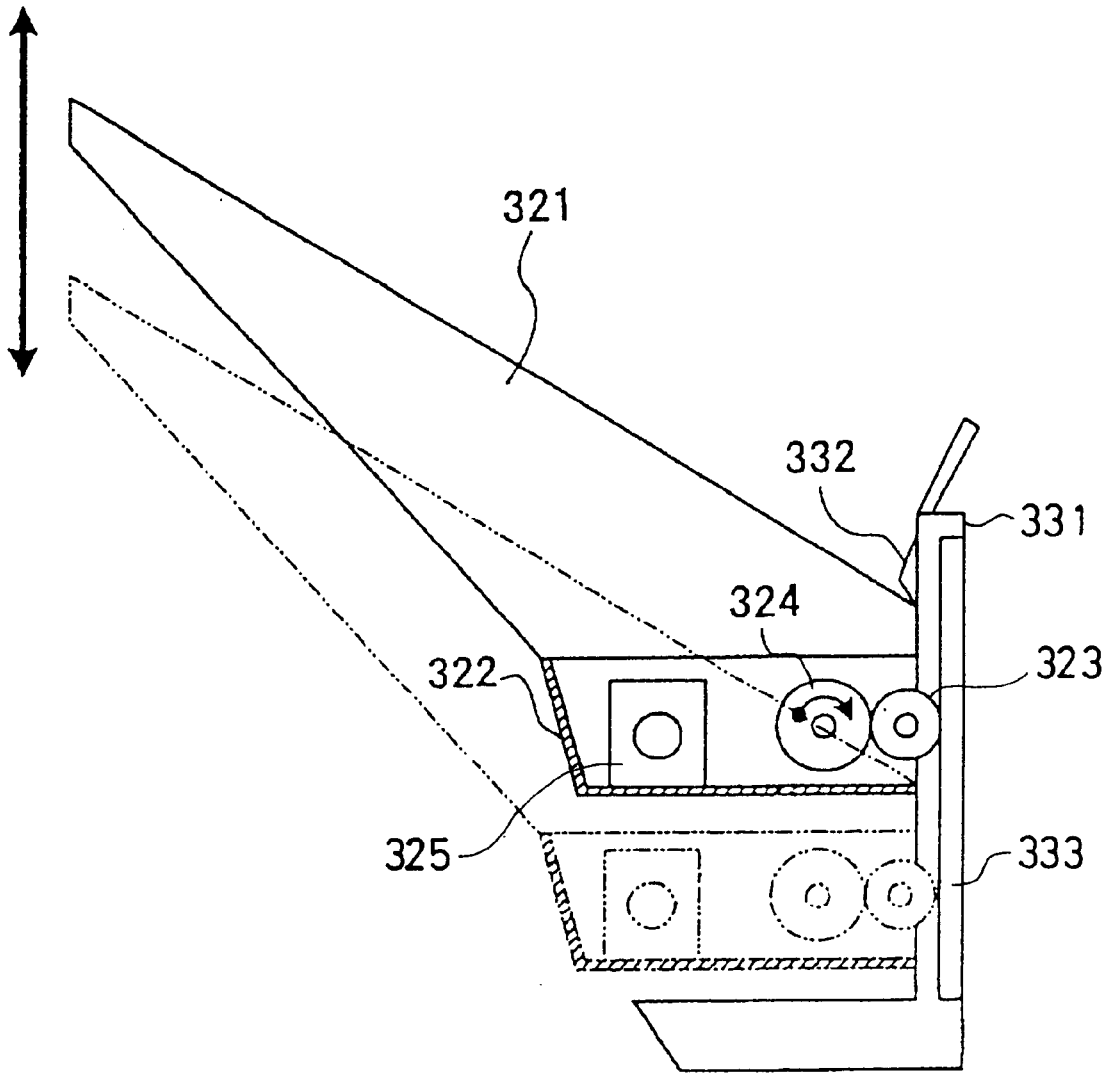
FIG. 3 describes a motion of the lifting mechanism for upper side stacking tray in FIG. 2.
Figure 4:
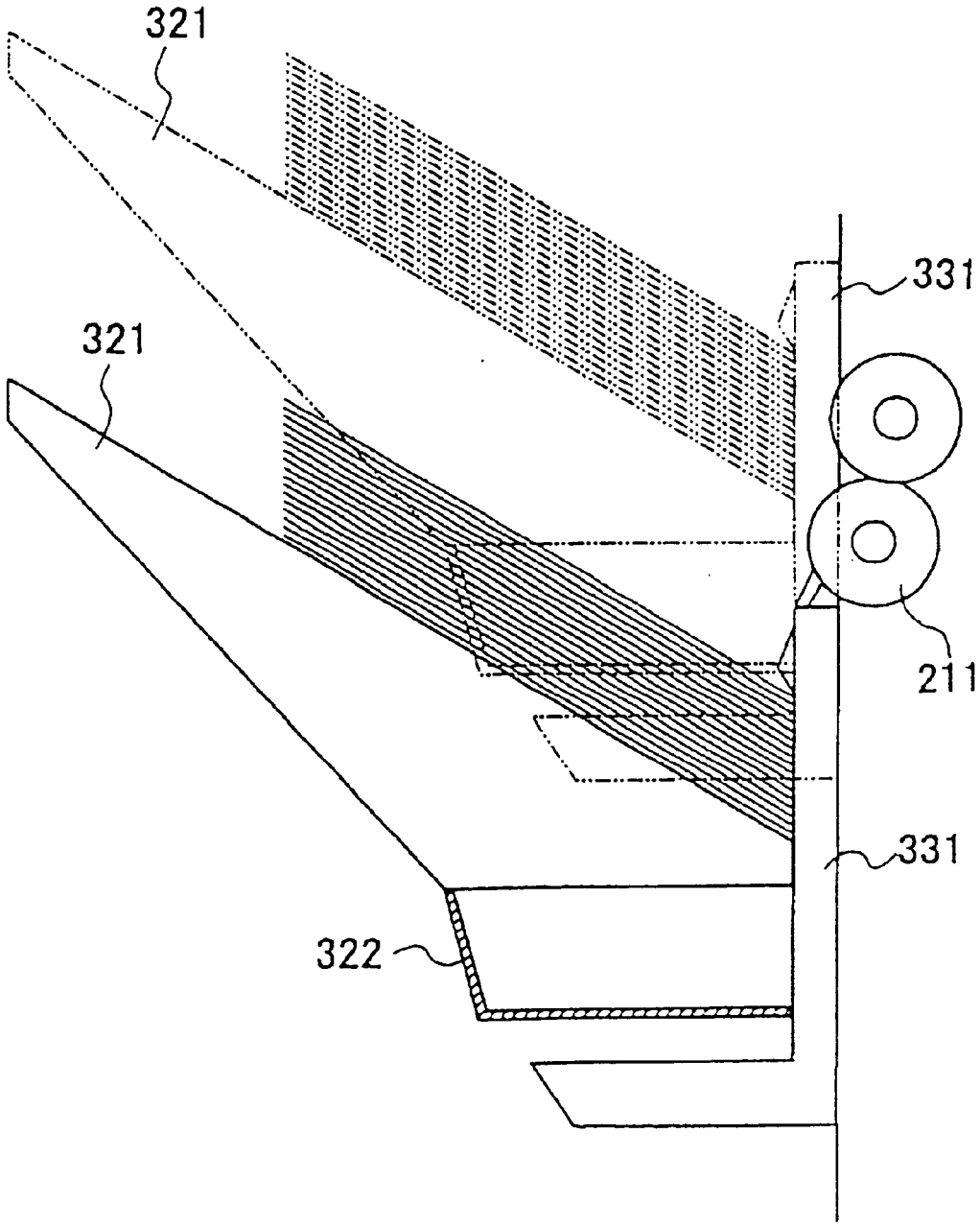
FIG. 4 describes a motion of the lifting mechanism for upper side stacking tray in FIG. 2, and indicates a state where a distance between a sheet discharging position and a sheet bundle stack position is maintained.

FIG. 2 shows a lifting mechanism for the upper side stacking tray, and FIGS. 3 and 4 describe the operation of mechanism. The following section describes the constitution and the motion of upper side stacking tray 321 referring to these Figures. FIG. 2(*a*) is a front view with a partial section view, and FIG. 2(*b*) is a plan view indicating a main part. Since a driving mechanism for the lower side stacking tray 301 is almost the same as the driving mechanism for upper side stacking tray 321, the detailed description thereof is suppressed.

In FIG. 2, the upper side stacking tray 321 is fixed to a receiving stand 322. The receiving stand 322 is fixed to a belt for transmitting a lifting drive (suppressed from Figure). The receiving stand 322 is provided with a DC solenoid 325, a lever 326, a clutch 324, and a pinion gear 323. The receiving stand 322 is provided with an end fence (rear end fence) 331 through a spring suppressed from Figure. The end fence 331 is provided with a rack 333 extending upward/downward. The end fence 331 is constituted in such a manner that it is lifted up/down integrally with the rack 333 through the pinion gear 323.

When the DC solenoid 325 is OFF in a standard state, the clutch 324 is set to rotate only in a direction A indicated in FIG. 2(*a*). Thus, the rack 333 and the pinion gear 323 prevent a downward travel of the end fence 331 by its own weight. As the result, the end fence 331 lifts up/down while maintaining a positional relationship with the upper side stacking tray 321.

When the upper side stacking tray 321 is not at the sheet discharging position, or, in other words, the upper side stacking tray 321 is waiting above the discharging roller 211, is moving down from the waiting position to the discharging position, or is moving up from the discharging position to the waiting position, the DC solenoid 325 is OFF, and the upper side stacking tray 321 and the end fence 331 move integrally.

When the DC solenoid 325 is ON, the lever 326 is pulled in a direction B indicated in FIG. 2(*b*), and the lock of clutch 324 is released. Then, the pinion gear 323 is allowed rotating in both directions, the downward restriction of end fence 331 is removed, and the end fence 331 is allowed traveling upward/downward.

When the upper side stacking tray 321 is moving from the waiting position (the position indicated by solid line in FIG. 1) to the discharging position (the position indicated by dash dot in FIG. 1), the DC solenoid 325 is OFF. In this state, the upper stacking tray 321 and the end fence 331 move down integrally, and a stopper (suppressed from Figure) stops the end fence 331 when the end fence 331 reaches the discharging position. After the upper side stacking tray 321 moves down further a predetermined distance (in this state, although the stopper stops the end fence 331, only the upper side stacking tray 321 moves down because of the lock direction of clutch 324), the DC solenoid 325 turns ON, the clutch 324 is released simultaneously, only the upper stacking tray 321 moves up, the upper stacking tray 321 stops when it reaches the sheet face detecting sensor 332, and the DC solenoid 325 turns OFF.

When sheets are sequentially discharged into the upper side stacking tray 321, as soon as the sheet post-processing apparatus 2 receives a sheet discharge signal from the main unit of copying machine 1 (refer to FIG. 30), the upper side stacking tray 321 moves down a predetermined distance from the position of sheet face detecting sensor 332, and stops, and moves down the predetermined distance again when the sheet face detecting sensor 332 detects a rear end of a discharged sheet. The upper side stacking tray 321 repeats the moving up to the position of sheet face detecting sensor 332 and the moving down the predetermined distance for every predetermined number of discharged sheets in synchronous with the ON/OFF of DC solenoid 325. This action maintains a distance between the sheet discharging position from the discharging roller 211 and the position of a face of stacked sheets as indicated in FIG. 4.

When the interruption tray discharging mode is selected on the operation part 12 of main unit of copying machine 1, the branching pawl 211' rotates, a sheet is conveyed to the interruption tray conveying path 210, and is discharged and stacked on the interruption tray 214 by the discharging rollers 213.

When the staple mode is selected on the operation part 12 of main unit of copying machine 1, the branching pawl 221 moves to convey a sheet into the staple conveying path 240. The sheet is discharged and stacked on the staple tray 402 by the staple tray discharging rollers 242.

Figure 5:
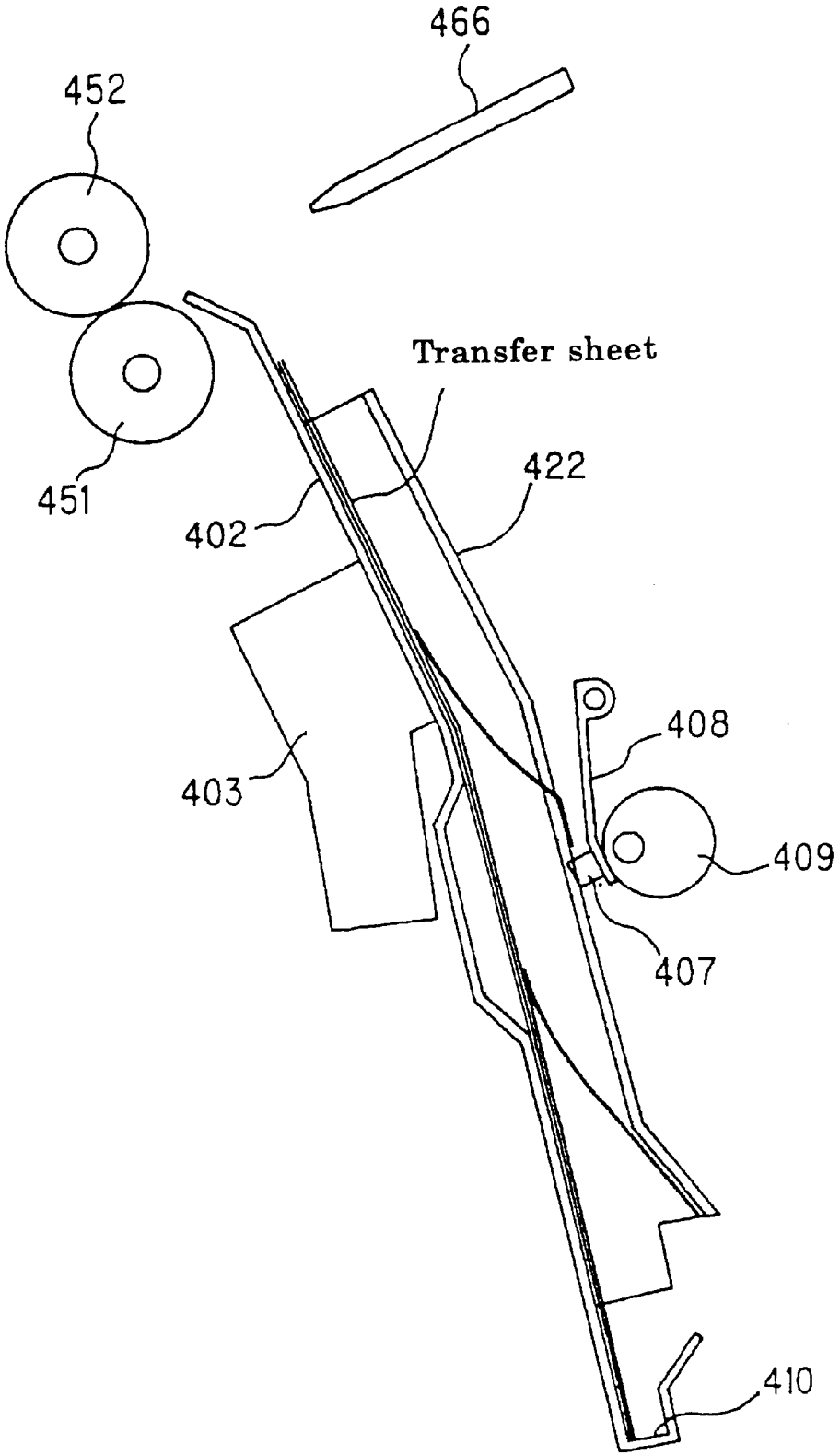
FIG. 5 describes a constitution overview of a mechanism for stapling for the sheet post-processing apparatus relating to the present embodiment.

The sheet discharged to the staple tray 402 is individually dropped downward in the staple tray 402 by the hitting roller 250, and pressed to the sheet rear end base fence 410 for aligning the rear end as indicated in FIG. 5. The sheet is also individually arranged in the crosswise direction of sheet by the jogger fence 422.

When the staple mode is selected on the controlling part 12 during mode selection, the discharging guide plate 231 is being opened by the rotation of cam 234 through the link 233. When the sheet end stapling is selected, after the jogger fence 422 aligns the last sheet, the end face stapler 401 applies stapling process to one or two locations at predetermined positions on a rear end of a sheet bundle. The ejecting pawl 423 (refer to FIG. 14) integrated with the ejecting belt (suppressed from Figure) lifts the stapled sheet bundle at least as high as the front end reaches the position of discharging roller 211. Then the discharging guide plate 231 enters the closed state through the rotation of cam 234. The sheet bundle is pressed against the discharging roller 211 by the own weight of discharging guide plate 231, and is discharged toward the lower stacking tray 301 or the upper stacking tray 321 by the discharging roller 211.

1.2 Center-stapling Mechanism

FIG. 5 describes a constitution overview of a mechanism for stapling.

When center-stapling is further selected on the operation part 12 during the mode selection, after the jogger fence 422 aligns the last sheet, the ejecting pawl 423 lifts the center of a sheet bundle upward so that the center is positioned at a center-stapling position, and two staplers 403 provided with a predetermined interval (120 mm in the present embodiment) in a direction orthogonal to the sheet conveying direction apply stapling treatment to two parts at the center.

A fixing member 408 is provided rotationally at a position opposing to the center-stapling staplers 403. Two clinchers are provided on the fixing member 408. Rotation of an eccentric cam 409 moves the two clinchers 407 toward the direction of center-stapling staplers 403, and stops them at predetermined positions as a motion description in FIG. 6. As the center-stapling staplers 403 move toward the clinchers 407, a sheet bundle is clamped, and predetermined positions on the sheet bundle are stapled. This action is shown in FIG. 7 in detail. Transfer sheet (sheet bundle), which stops at the center-stapling position 411 as indicated in FIG. 7(*a*), is clamped at the center as indicated in FIG. 7(*b*) by the clinchers 407, and then, is stapled at the center by an operation of the center-stapling staplers 403 as indicated in FIG. 7(*c*).

Figure 6:
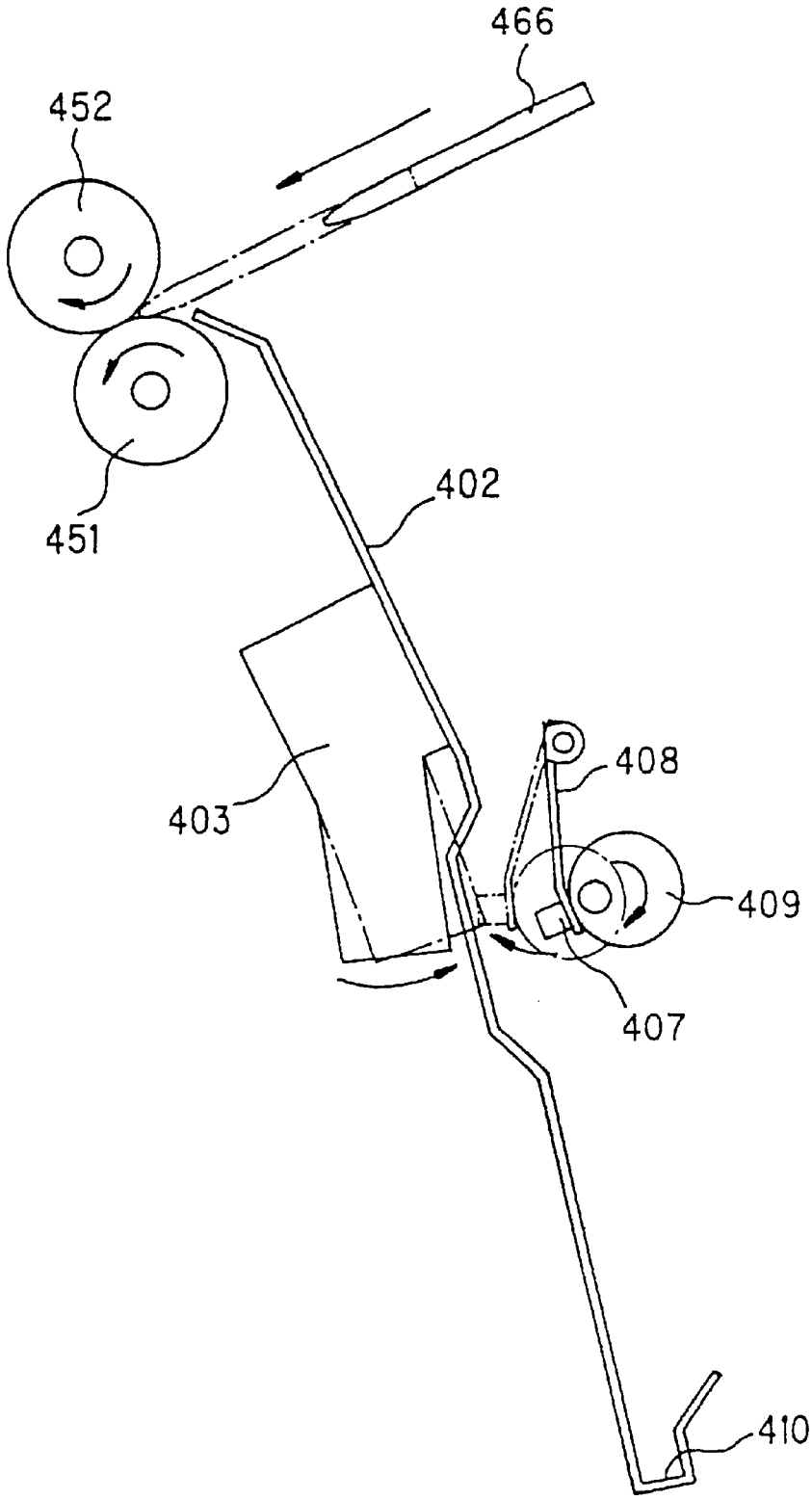
FIG. 6 describes a motion of the stapling mechanism in FIG. 5.
Figure 7:
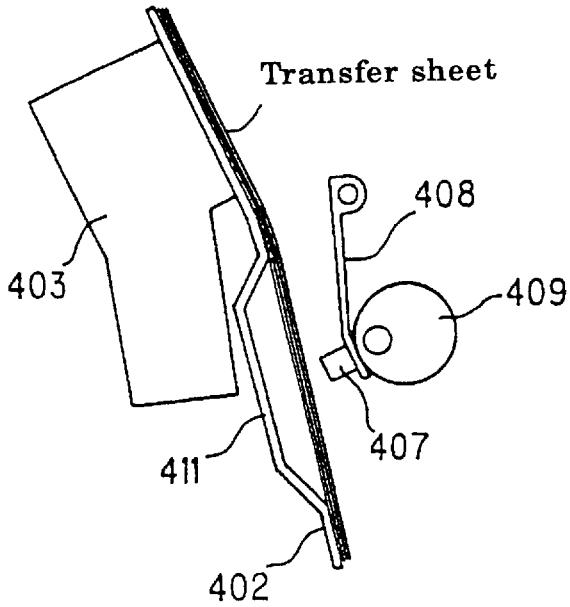
FIG. 7 describes the motion of the mechanism in FIG. 5 in detail.
Figure 7:
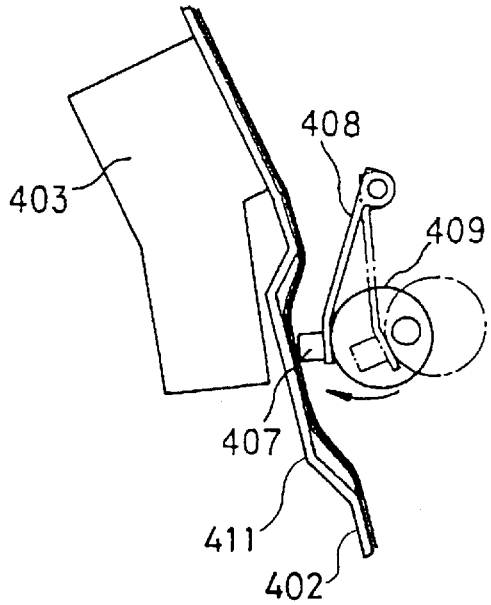
Figure 7:
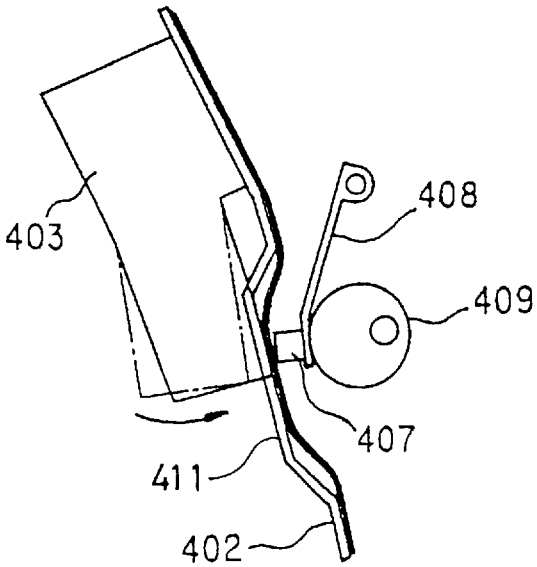
Figure 15:
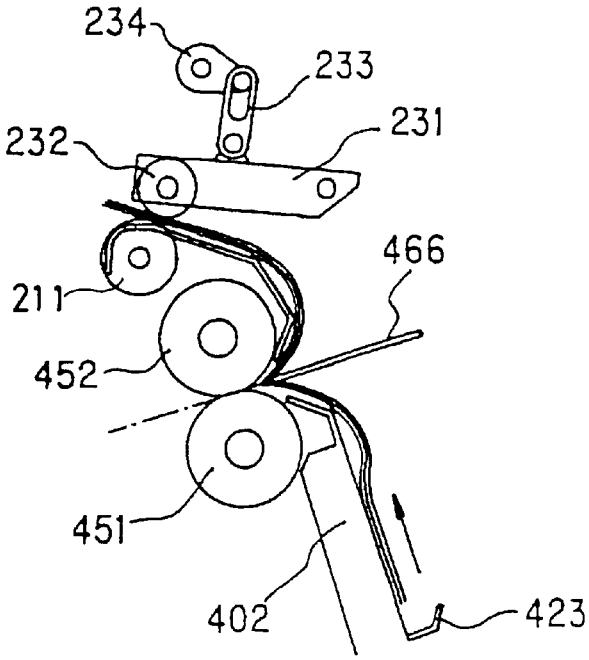
FIG. 15 shows a state where the end of a sheet bundle is fixed, and the folding plate pushes a part to be stapled on the sheet bundle toward the folding rollers to apply a folding process to the center of sheet bundle.

The sheet bundle which are stapled at the center by the operations indicated in FIGS. 6 and 7, are lifted upward by the ejecting pawl 423, and stops when the position stapled by the center-stapling staplers 403 reaches a predetermined position. Then, the discharging guide plate 231 in an open state indicated by dash dot in FIG. 14 enters a closed state indicated by solid line, and a part near a front end of the sheet bundle is clamped. Then, a driving motor suppressed from Figure for the discharging roller 211 is locked, and the discharging roller 211 is fixed. With this operation, a front end of the sheet bundle is fixed, and a folding plate 466 presses the sheet bundle toward the folding rollers 451 and 452 opposing to staple positions of the sheet bundle as indicated in FIG. 15. After the folding rollers 451 and 452 apply clinching treatment at the center of sheet bundle, the sheet bundle is discharged and stacked on the lower side stacking tray 301.

When the front end of sheet bundle is fixed by the discharging guide plate 231 in this way, a movement of the sheet bundle caused by a bulge generated when the folding plate 466 pushes the sheet bundle is limited to a constant direction from the free rear end of sheet bundle. Locking the discharging roller 211 secures the fixture of sheet bundle by the discharging guide plate 231.

When folding is not conducted after the center-stapling, the discharging action is the same as that for the end stapling, and a sheet bundle is discharged through the discharging roller 211.

1.3 Folding Mechanism

Figure 8:
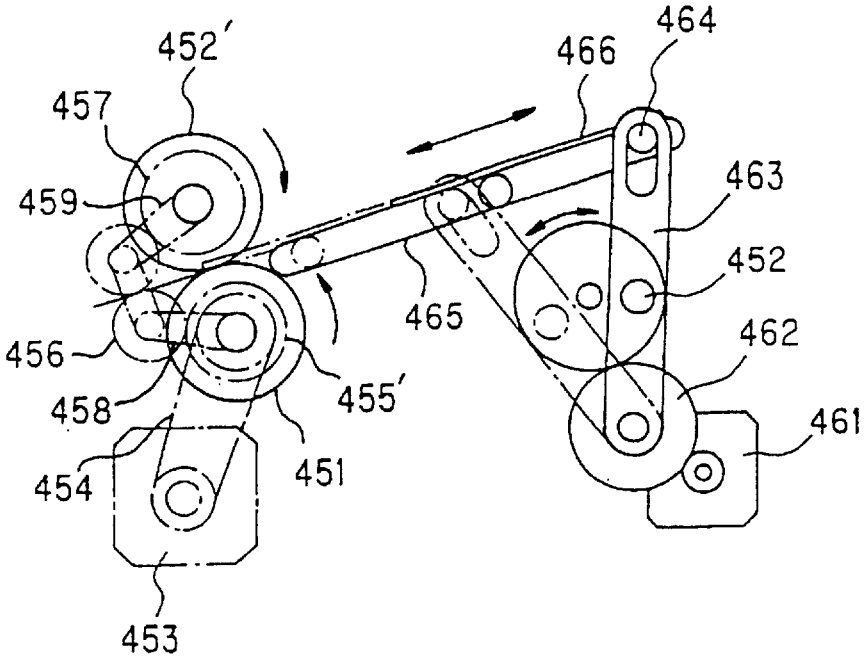
FIG. 8 describes a constitution overview of a mechanism for folding sheet for the sheet post-processing apparatus relating to the present embodiment.

FIG. 8 describes a constitution overview of a mechanism for folding sheet at the center.

Figure 9:
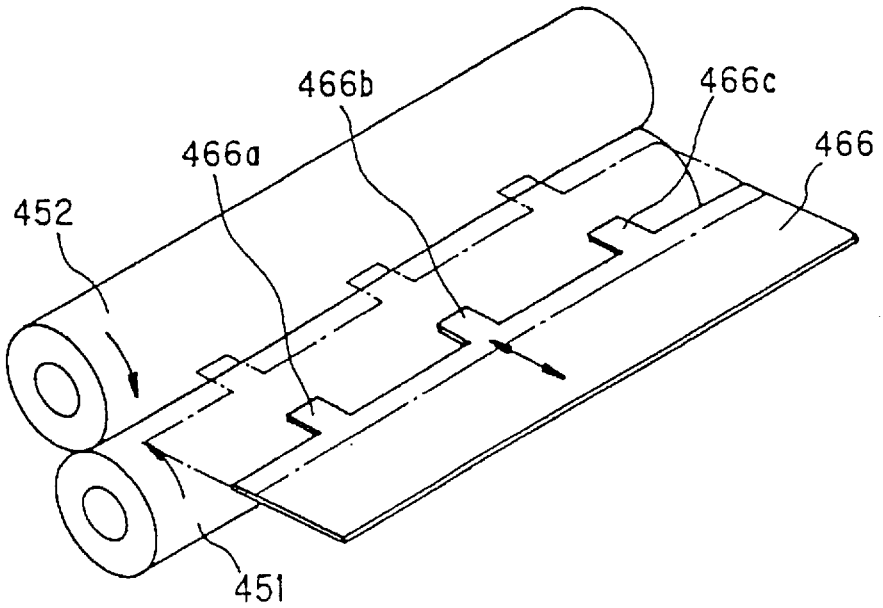
FIG. 9 is an oblique perspective view representing a relationship between a folding plate and folding rollers in FIG. 8.

In Figure, for the folding plate 466, a shaft 464 integrated with the folding plate 466 is provided for moving along a guiding groove 465. A rotational driving force of a folding plate driving motor 461 is transmitted to a cam 452' through an intermediate gear 462. A link 463 conducts a reciprocating movement of the folding plate 466. As observed from the oblique perspective view representing a positional relationship between the folding plate 466 and the folding rollers 451 and 452 in FIG. 9, three protruded parts 466*a*, 466*b*, and 466*c* are provided on an edge of the folding plate 466. The two protruded parts 466*a* and 466*c* on both sides are provided at the same positions as the staple positions (120 mm of interval in the present embodiment) of center-stapling staplers 403. The center protruded part 466*b* is provided at the center position between the two staple positions of center-stapling staplers 403.

As indicated in FIG. 8, a driving force of a folding roller driving motor 453 is transmitted to a driving gear pulley 455' through a timing belt 454. A driving force of the driving gear pulley 455' transmitted to an intermediate gear 456 and a driven gear 457, thereby rotationally driving both the folding rollers 451 and 452.

The driving gear pulley 455', the intermediate gear 456, and the driven gear 457 are connected with arms 458 and 459, and are constituted in such a manner that they move while intervals between the individual shafts are being maintained. The rotational driving force is surely transmitted to both of the folding rollers 451 and 452 even in a state where the folding rollers 451 and 452 clamp a sheet bundle, and are separated. The folding rollers 451 and 452 are elastically urged in a mutually approaching direction by an extension spring, which is suppressed from Figure, and are pressed into contact with each other at the nip part at a predetermined pressure.

1.4 Operation in Folding

Figure 10A:
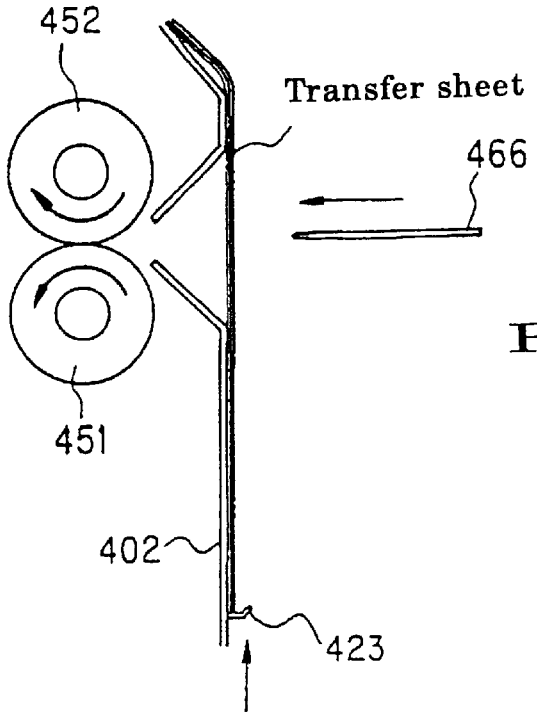
FIG. 10 describes a motion for using the folding plate to fold a sheet bundle and discharging it, (a) shows a state before the folding plate comes in contact with the sheet bundle, (b) shows a state where the folding plate is in contact with the sheet bundle, and the sheet bundle is folded, and (c) shows a state where the folding plate is retracted from the folding rollers.
Figure 10B:
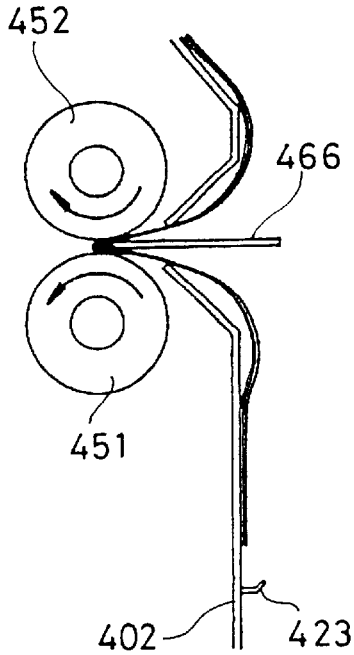
Figure 10C:
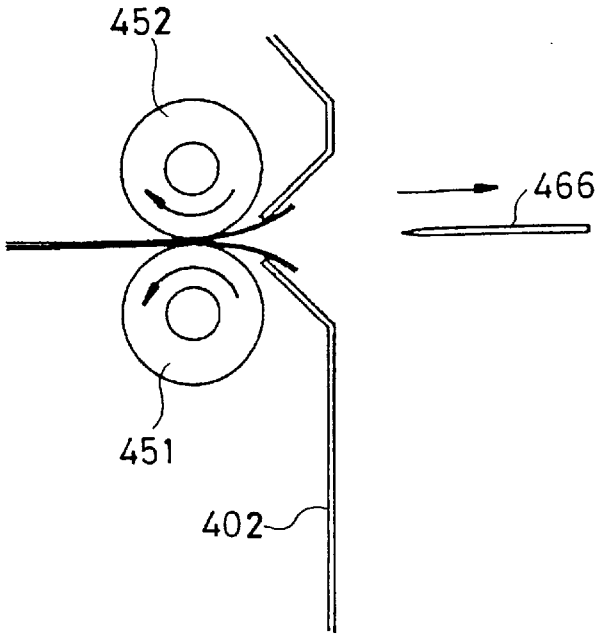

FIG. 10 describes a motion for using the folding plate 466 to fold a sheet bundle and discharging it.

Figure 11A:
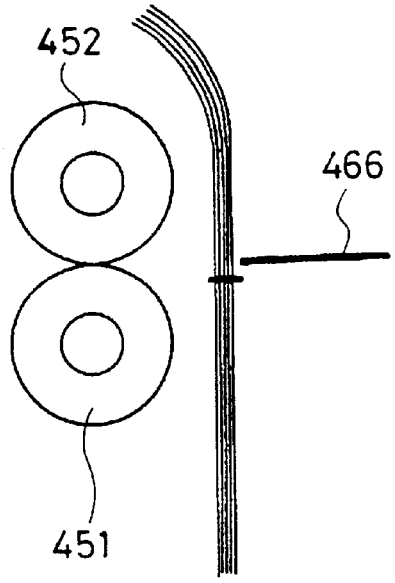
FIG. 11 describes a motion indicating a relationship between a staple and a position to be folded when a folding plate folds a sheet bundle, (a) shows a state where the folding plate is just over the staple before the folding plate comes in contact with the staple, (b) shows a state where the staple is approaching the folding plate due to the folding by the folding plate, and (c) shows a state where the staple and the folding plate match.
Figure 11B:
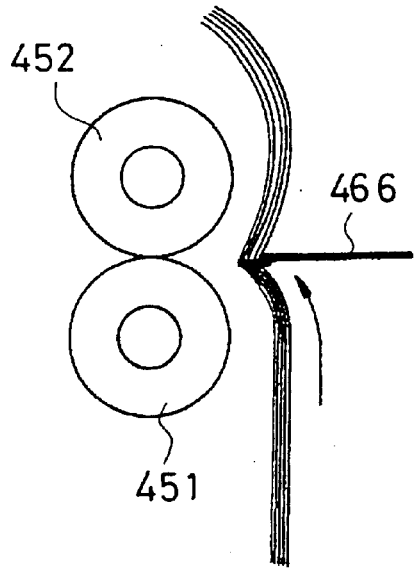
Figure 11C:
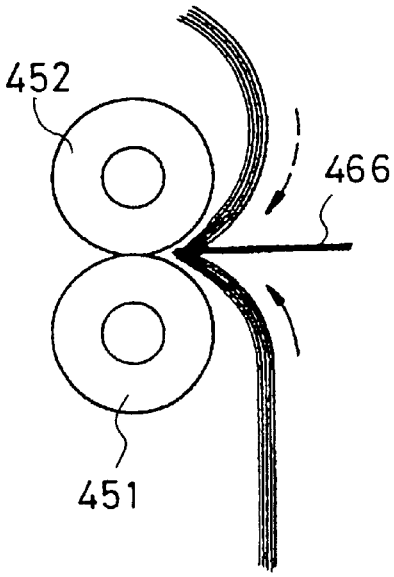
Figure 12:
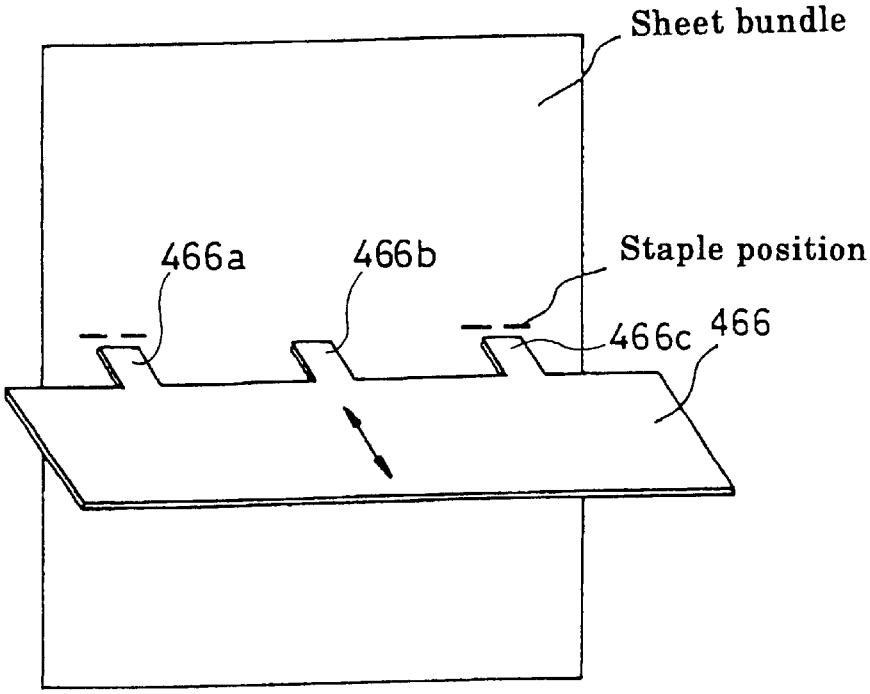
FIG. 12 is an oblique perspective view indicating a folded part when the folding plate folds a sheet bundle.

In FIG. 10(*a*), protrusions 466*a*, 466*b* and 466*c* move forward, and press the staple positions on a sheet bundle as indicated in FIG. 12. The folding plate 466 moves forward to a position beyond the nip position of folding rollers 451 and 452 as indicated in FIG. 10(*b*). In this state, a press contact and a rotation of the folding rollers 451 and 452 apply a folding treatment at the center of sheet bundle. Since a part of the sheet bundle clamped between the protrusions 466*a*, 466*b*, and 466*c* of folding plate 466 and the folding rollers 451 and 452 are not directly pressed into contact by the folding rollers 451 and 452, the part presents an improper folding state according to the thickness of folding plate. Folding condition at the staple positions is worsen than that at places without staple due to the thickness of staples. Matching the protrusions 466*a* and 466*c* of folding plate 466 with staple positions on a sheet bundle as shown in FIGS. 11(*c*) and 12 matches the positions where the folding state is not sufficient with the staple positions, thereby securing the minimum folding state.

Figure 13:
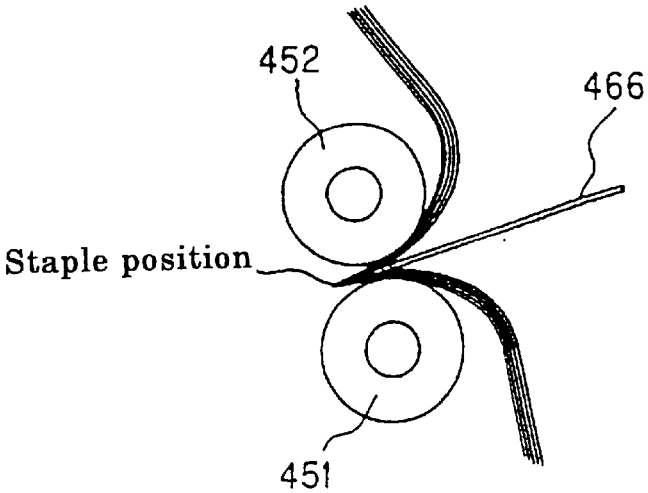
FIG. 13 shows a state where the folding plate protrudes along with a sheet bundle beyond the nip of folding rollers for folding.

The folding plate 466 presses just on the staple positions stapled by the center-stapling stapler 403 (FIGS. 11 and 12), hooks staples on the sheet bundle whose front end is fixed with the discharging guide plate 231, and presses in toward the folding rollers 451 and 452 while receiving resistance from friction (FIG. 13). With this operation, a folding treatment where the staple positions and the folding position surely match on a sheet bundle is applied. When positions a little above the staple positions are pressed as indicated in FIG. 11(*a*), the rear end of sheet bundle is lifted up as indicated in FIG. 11 (*b*), and protrusions 466*a* and 466*c* match the staple positions as indicated in FIG. 11(C).

The protrusions 466*a*, 466*b*, and 466*c* of folding plate 466 press the sheet bundle, and fixes the front end of sheet bundle at a position beyond the nip position of folding rollers 451 and 452, the folding plate 466 presses the staple positions on the sheet bundle toward the folding rollers 451 and 452, the folding rollers 451 and 452 apply the folding treatment at the center of sheet bundle, and then, the sheet bundle is discharged and is stacked on the stacking tray 301. In this state, fixing the front end of sheet bundle with the discharging guide plate 231 stabilizes the folding position as indicated in FIG. 15. Locking the discharging roller 211 surely fixes the sheet bundle with the discharging guide plate 231.

As indicated in FIG. 13, the protrusions 466*a*, 466*b*, and 466*c* press the sheet bundle. For the operation that the protrusions 466*a*, 466*b*, and 466*c* move forward to a position beyond the nip position of folding rollers 451 and 452, and the press contact and the rotation of folding rollers 451 and 452 apply the folding treatment to the center of a sheet bundle, it is necessary that the advanced protrusions 466*a*, 466*b*, and 466*c* of folding plate 466 retract from the state where the folding plate 466 is pressed between the folding rollers 451 and 452 and the sheet bundle. Since the parts of folding plate 466 clamped by the folding rollers 451 and 452 are only the protrusions 466*a*, 466*b*, and 466*c*, and a friction force applied from the folding rollers 451 and 452 is small, a load on the driving part for retraction is small.

When the folding plate 466 has two protrusions, the center of a sheet bundle is not fully pressed when the sheet bundle is pressed against the folding rollers 451 and 452, and presents a bend, thereby generating wrinkles at the center when folded.

The protrusions 466*a*, 466*b*, and 466*c* are provided at three positions on the folding plate 466 in embodiment of present invention. This constitution prevents the wrinkles from being generated when the sheet bundle is pressed to the folding rollers 451 and 452.

1.5 Discharging and Stacking Mechanism for Folded Sheet Bundle Applied and the Operation Thereof As indicated in FIGS. 13 and 15, the folding plate 466 pushes the center of a sheet bundle between the folding rollers 451 and 452. The rollers 451 and 452 directly discharge the sheet bundle folded at the center from a discharging opening opened on the end fence 331.

Figure 19:
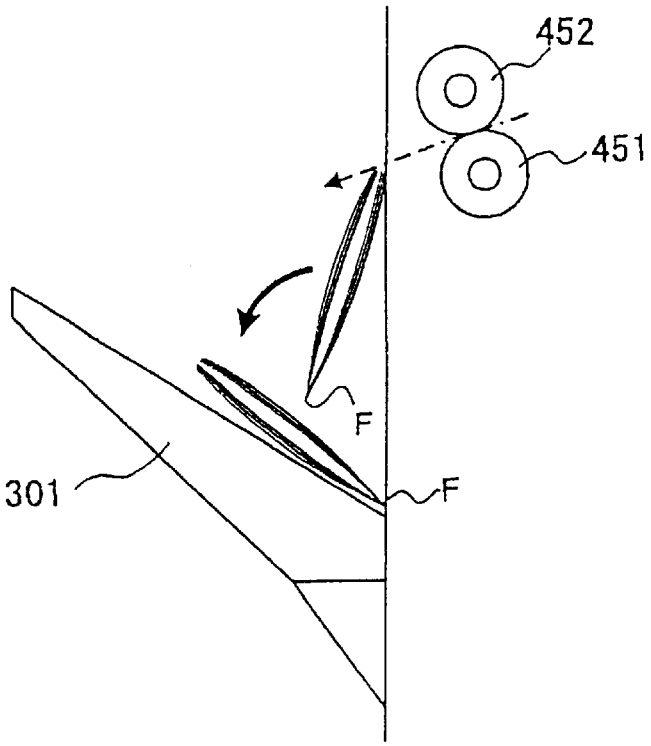
FIG. 19 shows a state where a sheet bundle falls while it is turning over.

As observed from FIG. 19 describing the turned-over state, the folding rollers 451 and 452 discharge the folded side F of a discharged sheet bundle first. However, when a sheet bundle is stacked on the lower stacking tray 301, or is stacked on stacked sheet bundles on the lower stacking tray 301, the sheet bundles is stacked while the folded side F faces the end fence 331, or, in other words, is stacked in a so called tuned over state.

Figure 16:
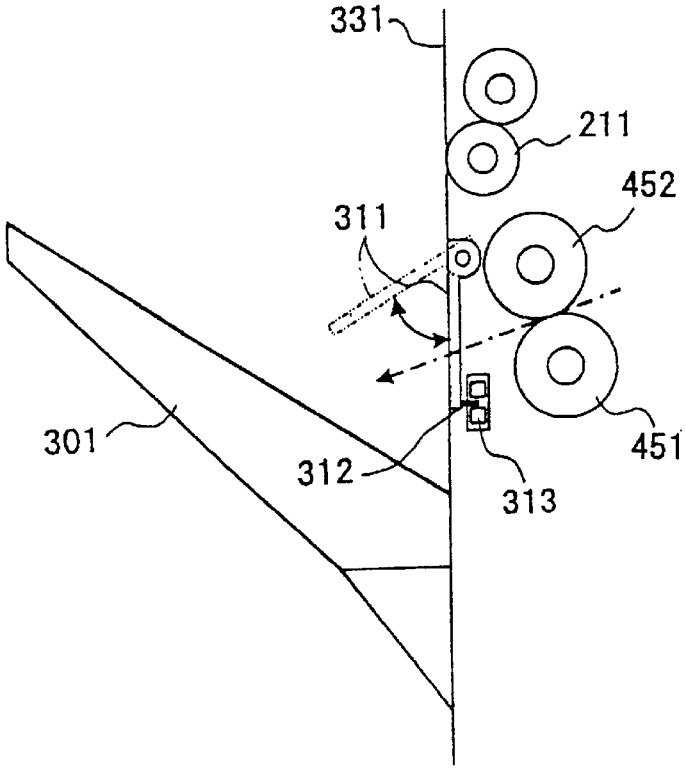
FIG. 16 is a front view of a main part showing an opening/closing end fence and a lower side stacking tray.

To turn over a sheet bundle, in the present embodiment, an opening/closing end fence 311 is provided at the discharging opening of end fence 331 as observed from a front view of a main part showing an opening/closing end fence (discharging opening) and the lower side stacking tray 301 of FIG. 16.

Figure 17:
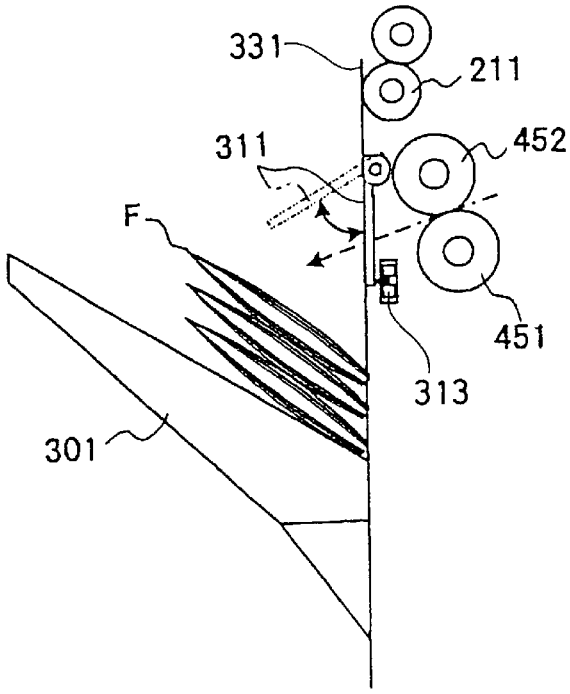
FIG. 17 is a front view of a main part showing a state where a sheet bundle is discharged while folded end of the sheet bundle is oriented toward the downstream side in a discharging direction, and is stacked.

The sheet bundle, to which the folding rollers 451 and 452 apply the folding treatment, pushes to open the opening/closing end fence 311, and is discharged on the lower side stacking tray 301. The opening/closing end fence 311 is urged toward a closing direction by an elastic member (suppressed from Figure). A sensor 313 for detecting a closed state is provided on the opening/closing end fence 311. The sensor 313 detects a state where a sheet bundle stapled at the center abnormally stops in the course of discharging. A maximum opening angle is set for the opening/closing end fence 311, and the opening/closing end fence 311 is urged elastically to a closing direction. Without this constitution, a sheet bundle discharged from the folding rollers 451 and 452 is stacked on the lower side stacking tray 301 while the folded side F of sheet bundle is positioned on the downstream side in discharging direction without being turned over as indicated in FIG. 17, resulting in a problem such as an irregular alignment.

Figure 18:
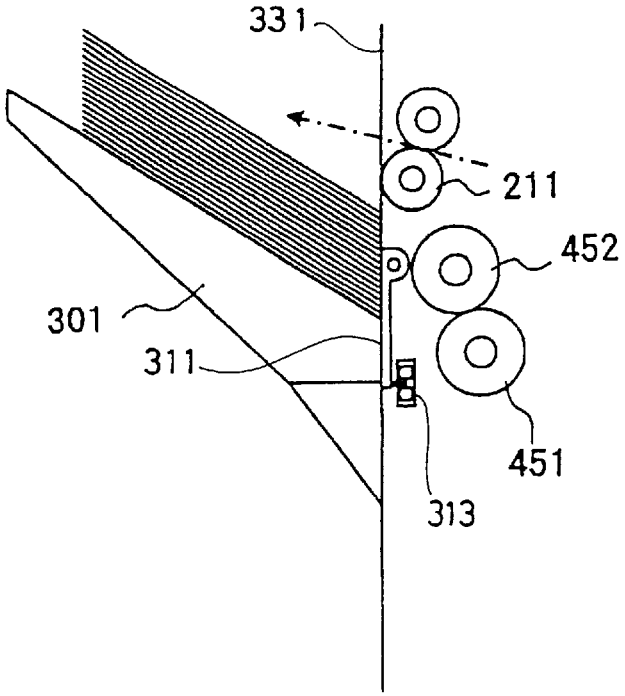
FIG. 18 is a front view of a main part showing a standard discharging state.

The opening/closing end fence 311 is flush with the end fence 331 in standard discharging so as not to prevent the lower side stacking tray 301 or the upper side stacking tray 321 from moving up/down along the end fence 331 as indicated in FIG. 18. Though the opening/closing end fence 311 is set flush with the end fence 311, it may be retracted from the end fence 331.

When the center-stapling mode and the center-folding mode are selected on the main unit of copying machine 1, as soon as copying starts, the lower side stacking tray 301 moves down along the end fence 331 from a non-staple discharging position near the discharging roller 211 or a stack position for sheet bundles stapled at the end face to a position a predetermined distance lower than the pressing plate 343 provided lower than the end fence 306 for pressing a bulge on the stapled side of a sheet bundle stapled at the center, and stops.

Figure 20:
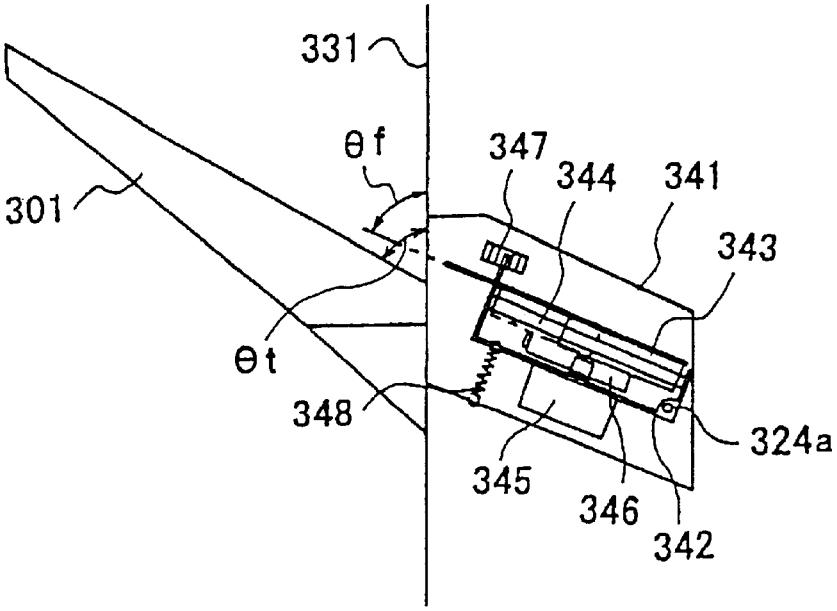
FIG. 20 is a front view of a main part showing a structure of a pressing plate.
Figure 21:
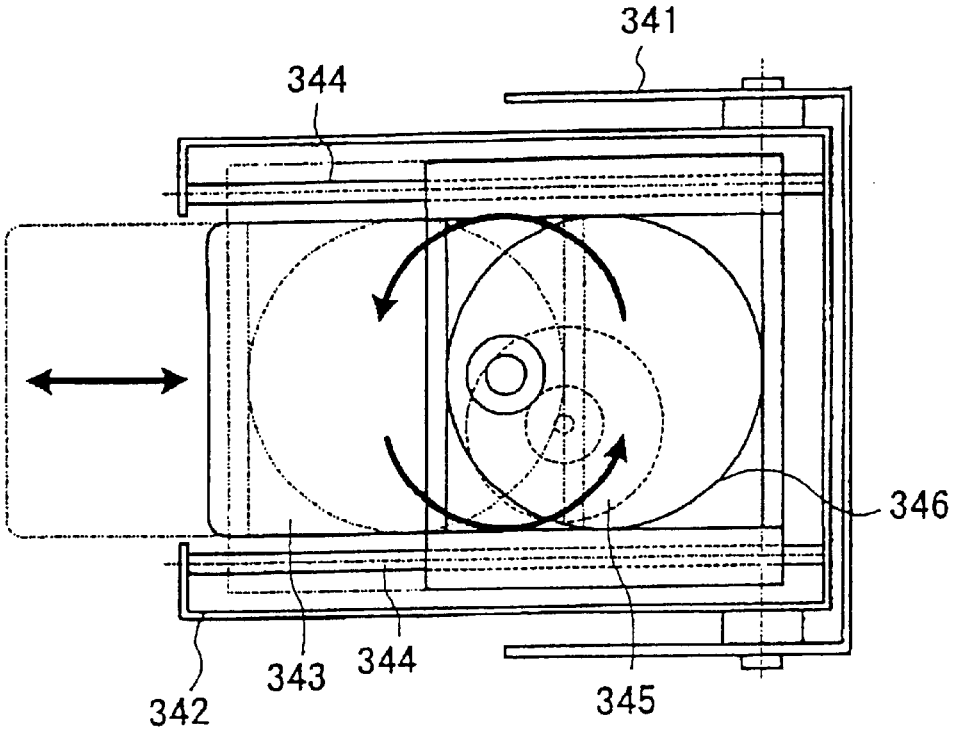
FIG. 21 is a plan view showing the structure of pressing plate.

A pressing mean for pressing a sheet bundle basically comprises the pressing plate 343, a motor for driving the pressing plate 345 for protruding/retracting the pressure plate 343, a cam 346 driven by the motor for driving the pressing plate 345, a motor fixing plate 342 for fixing the motor for driving the pressing plate 345, a spring 348 for always elastically urging the motor fixing plate 342 in a counterclockwise direction indicated in Figure about a fulcrum 342*a*, and a sensor 347 for detecting the position of motor fixing plate 342 as indicated in the front view of FIG. 20 showing an internal structure and in the plan view of FIG. 21.

Just after the lower side stacking tray 301 stops, the motor for driving the pressing plate 345 rotates the cam 346 to move the pressing plate 343 forward along a guide shaft 344 provided on the motor fixing plate 342. The pressing plate 343 stops at a position protruded a predetermined distance from a base face of the end fence 331. The lower side stacking tray 301 starts moving up again, lifts the pressing plate 343, and continues moving until the pressing plate sensor 347 detects a part of the motor fixing plate 342. The motor fixing plate 342 is rotationally integrated into a housing 341. The housing 341 is fixed to the end fence 331. The motor fixing plate 342 is connected with the housing 341 through the spring 348. With this constitution, the pressing plate 343 presses on a top face of the lower side stacking tray 301.

The pressing plate 343 protrudes/retracts linearly. An angle between the pressing plate 343 and the lower side stacking tray 301 is set as:

$$\theta f \geqq \theta t$$

where θf is an angle between the pressing plate and the end fence 331 on the sheet bundle discharging side when the pressing plate sensor 347 detects a part of the motor fixing plate, and θt is an angle between the stacking face of lower side stacking tray 301 and the end fence 331. In this way, consideration is provided for preventing a sheet bundle from displacing when pressed.

In an example described in FIGS. 20 and 21, the pressing plate 343 protrudes/retracts linearly. Considering an interference between the pressing plate 343 and a sheet bundle, the pressing plate 343 may advance with an upward angle to the sheet stacking face of stacking tray 301, may maintain a downward angle to the sheet stacking face of stacking tray 301 when it fully protrudes, and may operate so as to maintain the angular relationship of θf≧θt. When the pressing plate 343 retracts into the end fence 331, the operation is inversed. This action is easily realized by using a cam set to a shape for a desired action of the pressing plate 343.

In FIG. 21, though one pressing plate 343 is shown, multiple of them are provided symmetrically about the center of the sheet bundle to press it. To use one pressing plate 343 to press a sheet bundle, it is necessary to use a pressing plate 343 having a predetermined width symmetrical about the center of sheet bundle. These constitutions are properly selected according to design purpose.

Figure 22:
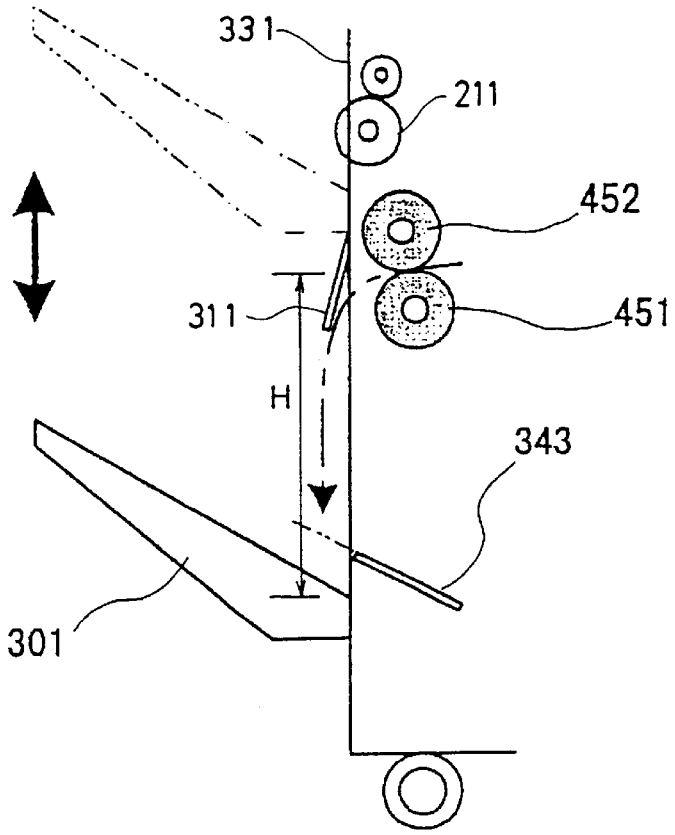
FIG. 22 describes a stack motion and a motion of a pressing plate.
Figure 24:
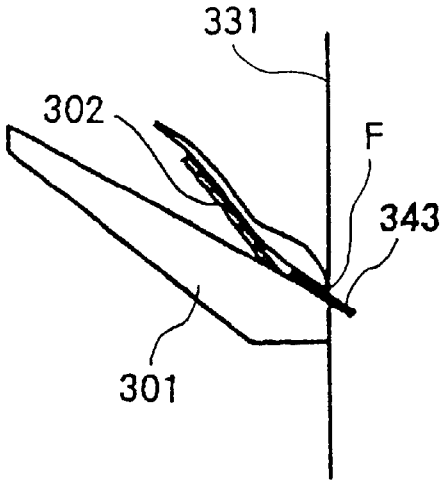
FIG. 24 shows a turned-over and stacked state of a sheet bundle when an auxiliary tray is used, and a operating state of a pressing plate, (a) shows a state where a sheet bundle is placed on a pressing plate, (b) shows a state where a stacking tray is being lifted down after the pressing plate is retracted, (c) shows a state where the stacking tray is lifted up, and a bulge of the sheet bundle is pressed, and (d) shows a state where a sheet bundle is placed on the pressing plate again.
Figure 24:
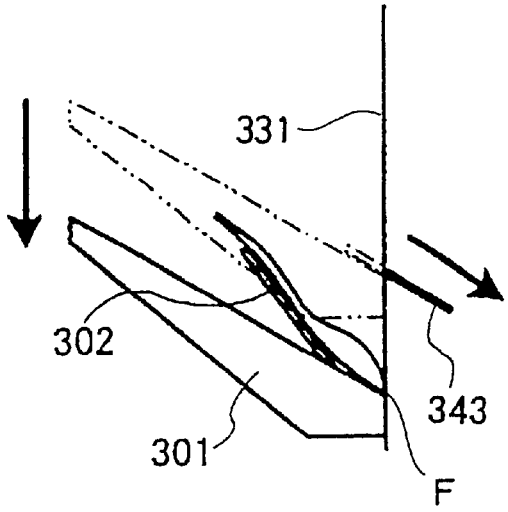
Figure 24:
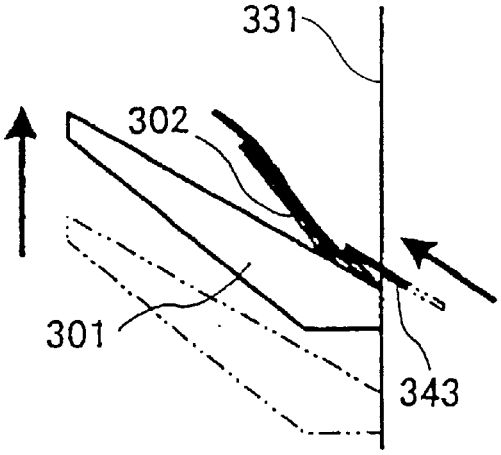
Figure 24:
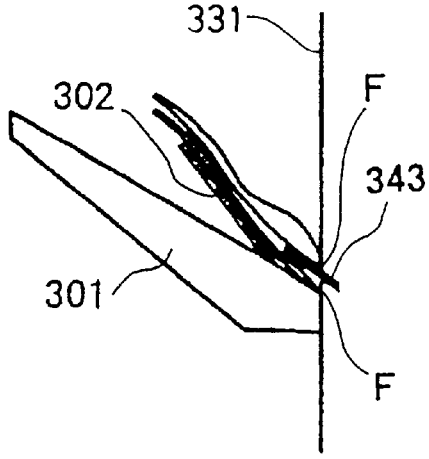

FIG. 22 describes a stack motion and a motion of the pressing plate 343. In FIG. 22, when a sheet bundle is discharged from the folding rollers 451 and 452, the folded side F is discharged first as indicated in FIG. 19. The opening/closing end fence 311 drops the sheet bundle vertically downward, the sheet bundle turns over on the lower side stacking tray 301, and the sheet bundle is stacked on the pressing plate 343 while the folded side F faces the lower direction (direction toward the end fence 331) (refer to FIG. 24(*a*)). FIG. 24 describes a state where an auxiliary tray 302 is used. After first bundle is stacked, the lower side stacking tray 301 moves down, and simultaneously the pressing plate 343 retracts. With this action, the sheet bundle is stacked on the lower side stacking tray 301 (refer to FIG. 24(*b*)). When the lower side stacking tray 301 stops after moving down a predetermined distance, the pressing plate 343 protrudes over the sheet bundle again. Then, the lower side stacking tray 301 moves up, and the sheet bundle is clamped between the pressing plate 343 and the lower side stacking tray 301. This action presses a bulged part of the sheet bundle (refer to FIG. 24(*c*)). Then, the next sheet bundle is discharged, and is stacked on the pressing plate 343 in a turned-over state (refer to FIG. 24(*d*)).

Actions described in FIGS. 24(*a*) to (*d*) are repeated for sheet bundles discharged sequentially, and multiple sheet bundles are stacked. The distance of moving down of the lower side stacking tray 301 per sheet bundle depends on the number of stapled sheets in a discharged sheet bundle, and the distance for moving down increases as the number increases. This control ensures that the pressing plate 343 presses a bulge at a folded part caused by the increased number of stapled sheets. In this embodiment, after a sheet bundle is detached from the folding rollers 451 and 452, it falls freely while the falling direction is restricted by the opening/closing end fence 311. A distance H between the lower side stacking tray 301 or top sheet face of sheet bundles stacked on the lower side stacking tray 301 and a nip part of the folding rollers 451 and 452 or a releasing part of a sheet bundle is set to larger than a conveying distance of a sheet bundle folded into two. This constitution ensures the free fall.

To prevent an unnecessary interference between a sheet bundle and the pressing plate 343 during the action above, and to increase the aligning property, the coefficient of friction on the bottom side is decreased, and the coefficient of friction on the top side is increased, in place of moving the pressing plate 343 non-linearly. With this arrangement, a stack state of the sheet bundles which are stacked by pushing out sheets is not disturbed when the pressing plate 343 is protruded, and the increased coefficient of friction returns sheet bundles toward the end fence 331 side, resulting in a better alignment when the pressing plate 343 retracts.

Figure 35:
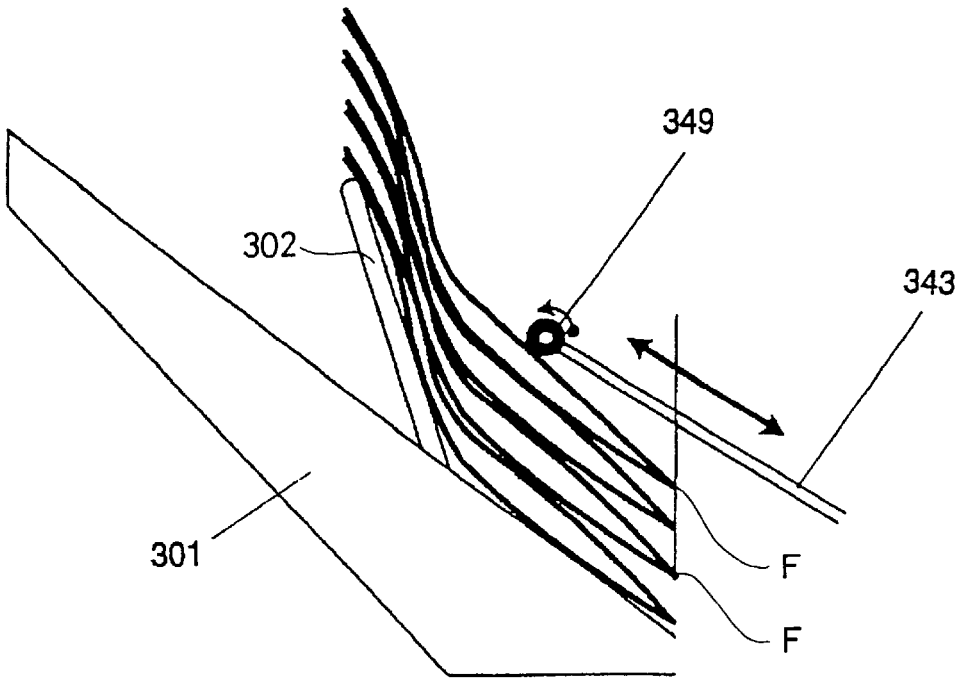
FIG. 35 shows an example of the pressing plate mechanism.
Figure 36:
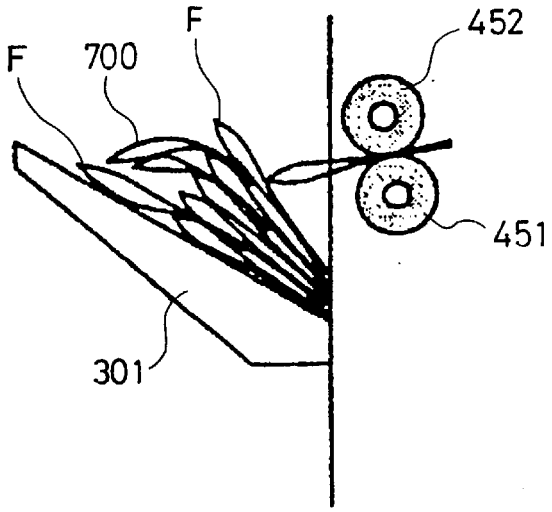
FIG. 36 shows an example of a state relating to a conventional apparatus where folded sheet bundles are stacked.

For example, as described in FIG. 35, it is possible to constitute in such a manner that a roller member 349 which rotates only in a counterclockwise direction in Figure, and has a high coefficient of friction on the face is provided at a tip of the pressing plate 343. This constitution prevents a sheet bundle from being displaced toward upper side on the lower side stacking tray 301 in Figure when a sheet bundle is pressed, and also prevents stacked sheet bundles from being pushed out to disturb the stack state of stacked sheet bundles when the pressing plate 343 protrudes while rolling on a top face of the sheet bundles which have been stacked on the lower side stacking tray 301. In the present embodiment the roller member 349 is prevented from rotating clockwise in Figure, it is possible to provide a torque limiter or the like to start rotating when a predetermined load is applied.

Figure 23:
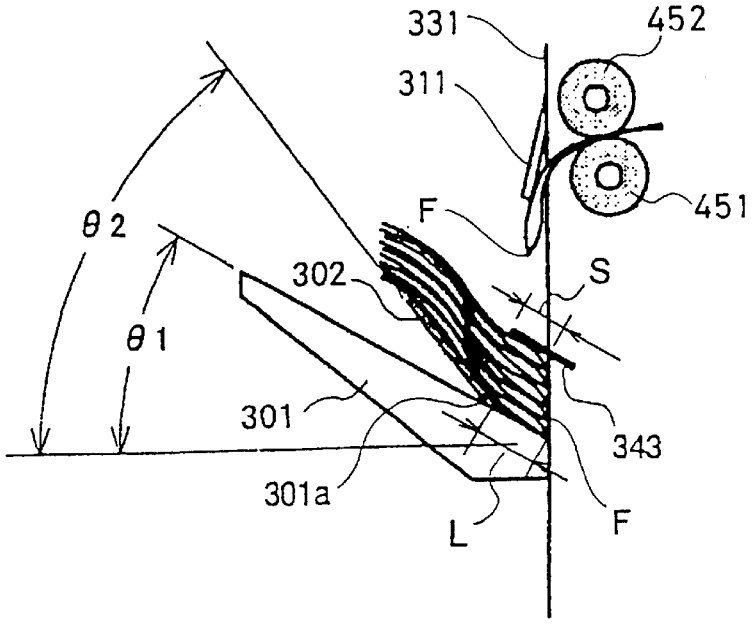
FIG. 23 shows an angular relationship between a lower side stacking tray and an auxiliary tray.

The auxiliary tray 302, which rises at a predetermined angle with a predetermined part as a fulcrum is provided on the lower side stacking tray 301 as indicated in FIG. 23.

Raising the auxiliary tray 302 changes an angle of the sheet stacking face of lower side stacking tray 301. The angle of auxiliary tray 302 can be changed to θ2 while the angle of stacking face of lower side stacking tray 301 from a horizontal state is θ1 as indicated in FIG. 23. In the present embodiment, these angles are set to:

$$\theta 1=30^\circ$$

$$\theta 2=55^\circ.$$

The auxiliary tray 302 changes the angle of stacking face from θ1 to θ2 to provide a steeper angle for the stacking face only when a sheet bundle applied with the center-stapling treatment, and the lower side stacking tray 301 is at the position for center-stapling mode.

With this constitution, a sheet bundle stapled and folded at the center is surely turned over and stacked on the lower side stacking tray 301, and the angle of stacking tray is set properly for stacking a non-staple discharged sheet or discharged sheets stapled at the end face.

1.6 Mechanism and Operation of the Auxiliary Tray

Figure 25:
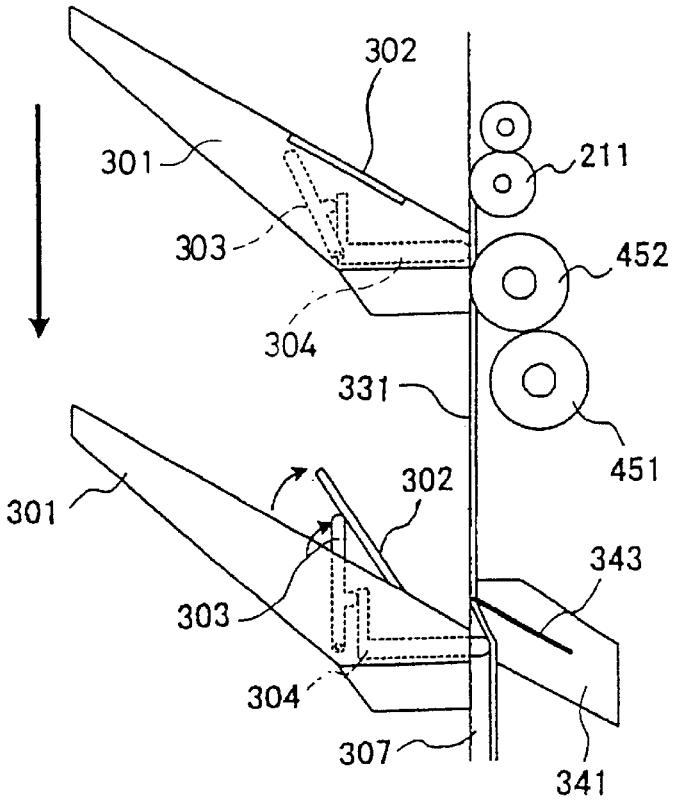
FIG. 25 shows a motion state of the lower side stacking tray and the auxiliary tray.
Figure 26:
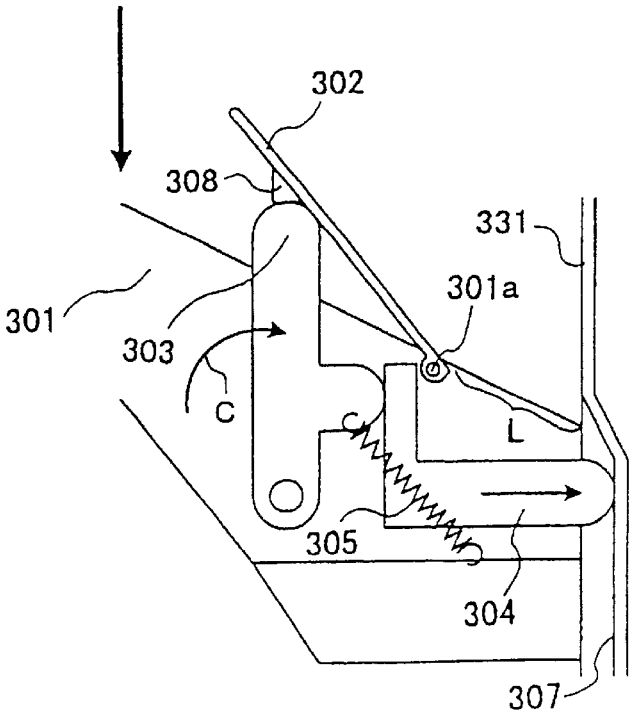
FIG. 26 describes the raising mechanism (rotating mechanism) for auxiliary tray in detail.
Figure 27:
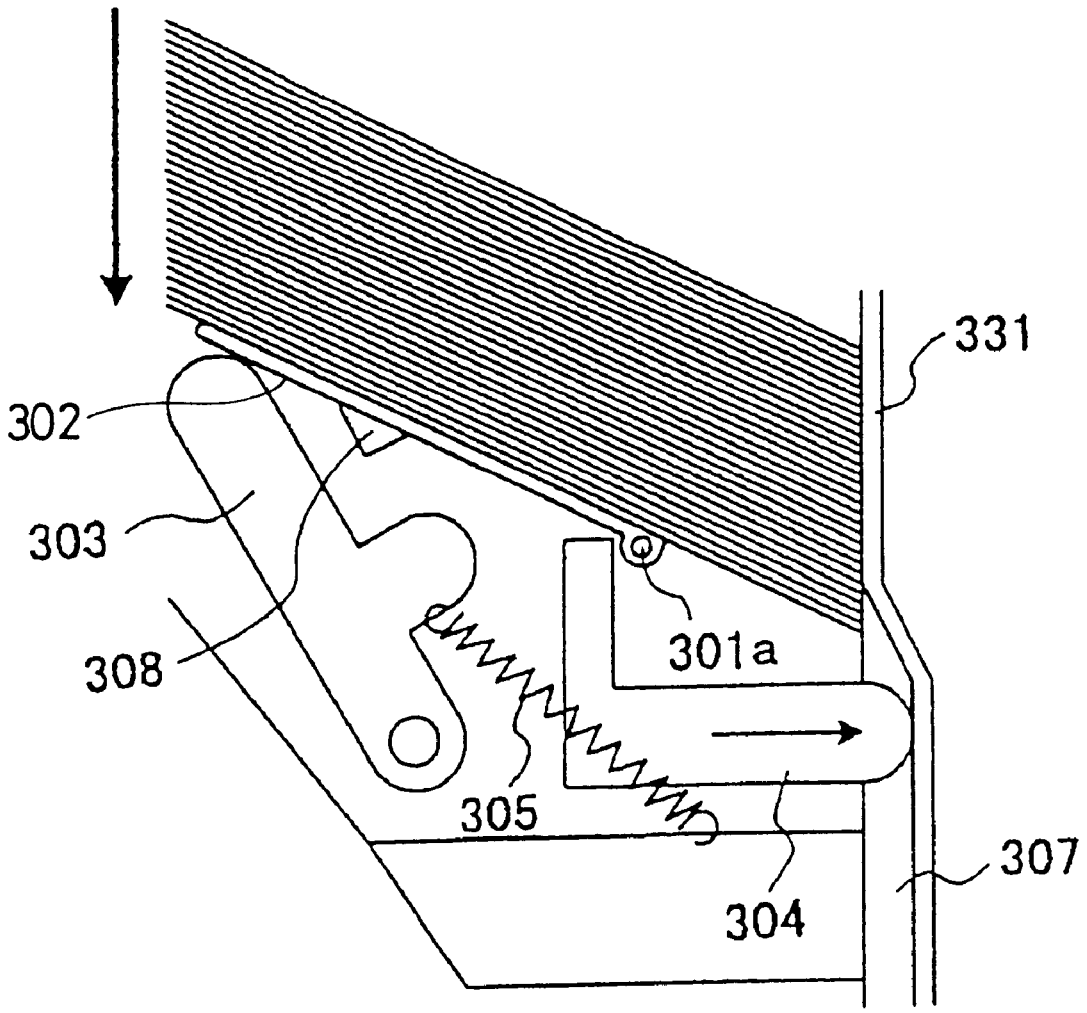
FIG. 27 shows a state of the raising mechanism for auxiliary tray used for the standard discharging.

FIG. 25 shows a motion state of the lower side stacking tray 301 and the auxiliary tray 302, FIG. 26 describes a raising mechanism (rotating mechanism) for the auxiliary tray 302 in detail, and FIG. 27 shows a state of the raising mechanism of auxiliary tray used for standard discharging.

The auxiliary tray 302 is provided so as to rotate in a predetermined range with an end of a lower side in a tilted direction as a fulcrum 301*a* with respect to the lower side stacking tray 301 as shown in FIG. 26. The lower side stacking tray 301 is provided with a pressing rod 304 and an arm 303. A spring 305 pulls the arm 303 toward C direction in Figure. When the lower side stacking tray 301 is in a position for a discharging mode other than the center-stapling discharge, the end fence 331 presses the pressing rod 304. This action rotates the arm 303, and the auxiliary tray 302 becomes flush with the upper face of stacking tray 301 (refer to FIG. 25). When the lower side stacking tray 301 moves down to a predetermined position in the center-stapling mode, the pressing rod 304 reaches a recessed part 307 of the end fence 331, and the end fence 331 releases the pressing. The spring 305 raises the arm 303, thereby raising the auxiliary tray 302 in clockwise direction as indicated in Figure. A protrusion 308 is provided on a rear face of the auxiliary tray 302. A tip of the arm 303 is in contact with the bottom end of protrusion 308. A state where an angle of the auxiliary tray 302, or, in other words, the angle of stacking face, is steep is maintained. When sheets other than a discharged sheets stapled at the center, or, in other words, sheets in a standard discharged state, are stacked, and the lower stacking tray 301 reaches the position for stacking discharged sheets stapled at the center, the auxiliary tray 302 is pressed by the own weight of stacked sheets to prevent the arm 303 from pressing down, and the angle of stacking face is maintained. The elastic force of spring 305 is set to operate this way. The proper position of fulcrum 301*a* from the end fence 331 is about:

$$L=40 \text{ mm}.$$

When the size of a sheet folded into two is considered, the position preferably exists in a range of:

$$L=40 \text{ mm } 10 \text{ mm}.$$

When the lower side stacking tray 301 moves above the position where the recessed part 307 is formed on the end fence 331, the arm 303 rotates counterclockwise as indicated in FIG. 26. With this action, the tip of arm 303 departs from the protrusion 308, and the lock becomes released. Then the auxiliary tray 302 returns to the original state on the lower side stacking tray 301, thereby allowing the standard discharging.

1.7 Angle of the Stacking Tray

The angle of stacking tray 301 is important for surely turning over a sheet bundle. When a sheet bundle is discharged from folding rollers 451 and 452, and is deflected downward by the opening/closing end fence 311, the flexibility of sheet bundle depends on the thickness. When the number of stapled sheets is small, or, in other words, the flexibility is large, the sheet bundle falls at an angle close to vertical by an elastic urging force toward the closing direction of opening/closing end fence 311. In this state, if the angle of lower side stacking tray 301 is the same as that for the standard discharging, when the folding side F of a sheet bundle comes in contact with the lower side stacking tray 301 or sheet bundles stacked on it, an angle on the end fence 331 side of angles between the end of folding side F and the lower side stacking tray 301 is obtuse, a slide toward the lower side (end fence 331 side) is generated, and a turning over action is conducted smoothly.

When a sheet bundle is thick, or, in other words, the flexibility of sheet bundle is low, it is not secured that the elastic urging force of opening/closing end fence 311 surely deflect the sheet bundle close to the vertical angle to drop. In this case, when the folding side F of sheet bundle comes in contact with the lower side stacking tray 301 or sheet bundles stacked on it, the angle on the end fence 331 side of angles between the end of folding side F and the lower side stacking tray 301 may be acute. When the angle on the end fence 331 side is acute, the sheet bundle cannot be turned over, and is not stacked in the turned-over state as intended.

To address this problem, considering the discharging angle of sheet bundle from the folding rollers 451 and 452, the angle of auxiliary tray 302 is increased to surely stack a sheet bundle in a turned-over state. Basically, when the end of folded side F of a sheet bundle comes in contact with the lower side stacking tray 301, the auxiliary tray 302, or a top sheet face of sheet bundles of them, if the end of folded side F slides toward the end fence 331 side, the sheet bundle is surely stacked on the tray with the turned-over state.

In the present embodiment, to surely slide a sheet bundle toward the end fence 331 side in this way, a rising angle θ2 for the auxiliary tray 302 is set to an angle more than an angle for turning over the sheet bundle. Since this angle is set in relation to the slide of a sheet bundle, it is set by the discharging angle of folding rollers 451, 452, the maximum opening angle of opening/closing end fence 311, and the elastic urging force toward the closing direction of opening/closing end fence 311.

1.8 Protruding Amount of the Pressing Plate

It is preferable to properly adjust the protruding amount S of pressing plate 343 according to a bulge of a sheet bundle, thickness of stack, the position of fulcrum 301*a* of auxiliary tray 302, and the like. Otherwise, the pressing plate 343 does not surely presses a sheet bundle. In previous FIG. 23, when the pressing plate 343 protrudes to a position vertically above the fulcrum 301*a* in this state, or, in other words, L=40 mm, if the protruding amount S is 40 mm, the top of pressing plate 343 comes in contact with a surface of a sheet bundle, which is tilted at a large angle, on the auxiliary tray 302. When the lower side stacking tray 301 moves up in this state, since the tip of pressing plate 343 is in contact with the surface of sheet bundle, the pressing plate sensor 347 immediately detects a part of the motor fixing plate 342, and the lower side stacking tray 301 stops. At this moment, the bulged part of sheet bundle is not in contact with a bottom face of the pressing plate 343, or is not pressed sufficiently though it is in contact.

To prevent this situation, it is necessary to reduce the protruding amount S so that the sheet bundle is pressed sufficiently between the pressing plate 343 and the lower side stacking tray 301. That protruding amount S is the distance L to the maximum fulcrum 301*a*. In this case, if a first bundle includes small number of stapled sheets, this distance is acceptable. However, for second sheet bundle or later, the thickness of sheet bundles increases, and the rising position of sheet bundles becomes close to the end fence 331, and the protruding amount S is set shorter accordingly. The protruding amount S is adjusted easily by using a stepping motor to drive the pressing plate 343 and limiting number of step pulses to be applied. Protruding/retracting a support mean for supporting the entire mechanism shown in FIGS. 20 and 21 according to the protruding amount S realizes the similar control.

Thus, the protruding amount S of pressing plate 343 is set so as to decrease according to the stacked number of sheet bundles on the stacking tray, and is set according to the number of stapled sheets as well. For the setting, the protruding amount S is experimentally obtained according to the number of stapled sheets and the number of stacked bundles, and is stored as a table in a memory in a controlling part 20 of a sheet processing apparatus 2 or a protruding amount setting part 34 by reading the protruding amount S according to the number of sheets.

1.9 Other Turning Over Mechanisms

In this form of embodiment, the opening/closing end fence 311 deflects the discharging direction of a sheet bundle to turn over the sheet bundle. Alternative methods for turning over a sheet bundle are:

(1) Change the peripheral speeds of pair of folding rollers 451 and 452 to orient the discharging direction of a sheet bundle downward.

(2) Pushing out a sheet bundle while a front end of the sheet bundle is in contact with the stacking tray to bend and turn over the sheet bundle.

(3) Pushing out a sheet bundle while a front end of the sheet bundle is in contact with the stacking tray, and push a rear end with the pressing member from the end fence 331 side to turn over while the sheet bundle is in contact state or a bent state.

Figure 28:
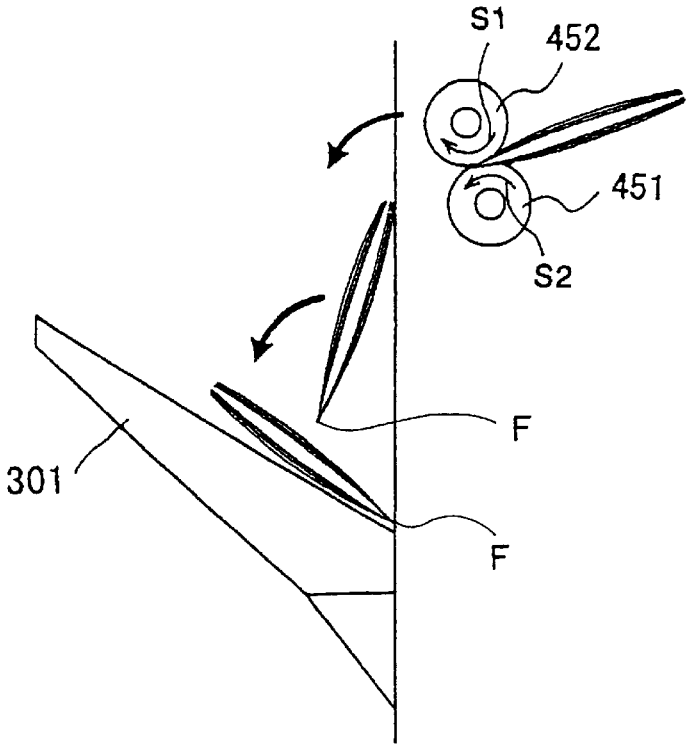
FIG. 28 shows an embodiment for changing peripheral speeds of the folding rollers to turn over a sheet bundle.

As an example of (1), as indicated in FIG. 28, if a peripheral speed of the upper side folding roller 451 and that of the lower side folding roller 452, which also serve as discharging rollers, are S1 and S2, they are set as:

$$S1>S2.$$

Constituting in this way surely discharges the folded side F downward without providing the opening/closing end fence 311. The other constituting elements including the lower side stacking tray 301 and the auxiliary tray 302 are the same as those in the embodiment described before.

Figure 29:
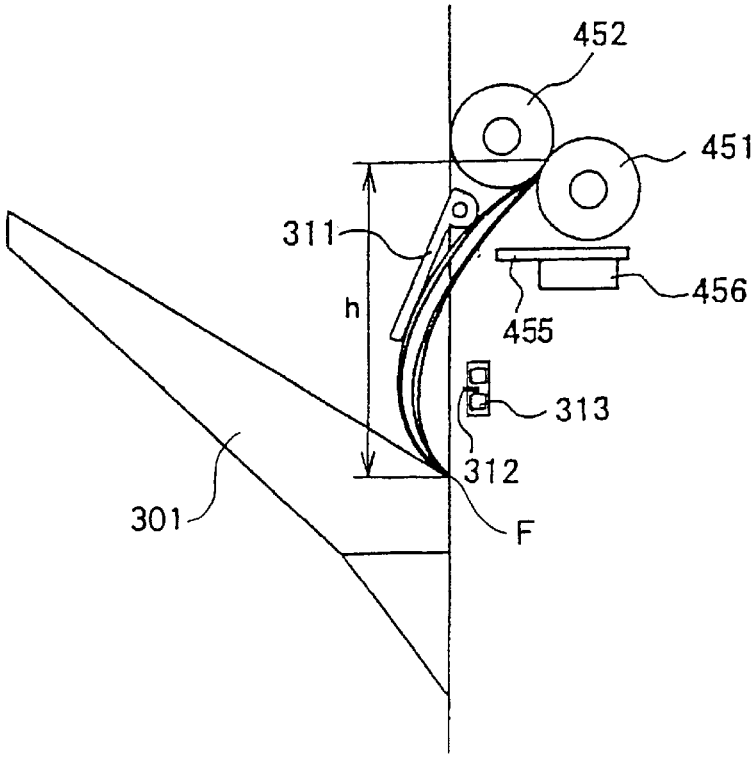
FIG. 29 shows an embodiment where a sheet bundle comes in contact with the lower side stacking tray to bend the sheet bundle for tuning over.

An example of (2) is shown in FIG. 29. In FIG. 29, a sheet bundle is forced to bend and turn over. In the present embodiment, the lower side stacking tray 301 moves up so that a height (h) between the nip position of folding rollers 451 and 452 and the lowest position of lower side stacking tray 301 is set smaller than the conveying distance of a sheet bundle folded into two, the opening/closing end fence 311 compulsorily leads the front end on the folded side F of sheet bundle to the lowest part of lower side stacking tray 301 or the lowest part of a top sheet of stacked sheet bundles to make them in contact with each other, and the folding rollers 451 and 452 are driven in this state. In this way, the sheet bundle is bent as indicated in FIG. 29, and is turned over and stacked on the stacking tray after discharged from the folding rollers 451 and 452. To surely turn over, a pushing-out member 455 and a driving apparatus 456 for protruding/retracting the pushing-out member 455 are provided to protrude the pushing-out member 455 when a sheet bundle is detached from the nip, thereby pushing a non-stapled side of the sheet bundle toward the lower side stacking tray 301. In this state, since the position of front end of sheet bundle, or, in other words, the front end on the folded side F, is restricted, though pushing a position closer to the non-stapled side than to the front end turns over the sheet bundle, pushing a part closer to the non-stapled side than to the center surely turns over the sheet bundle.

2. Control Constitution 2.1 Overall Constitution

Figure 30:
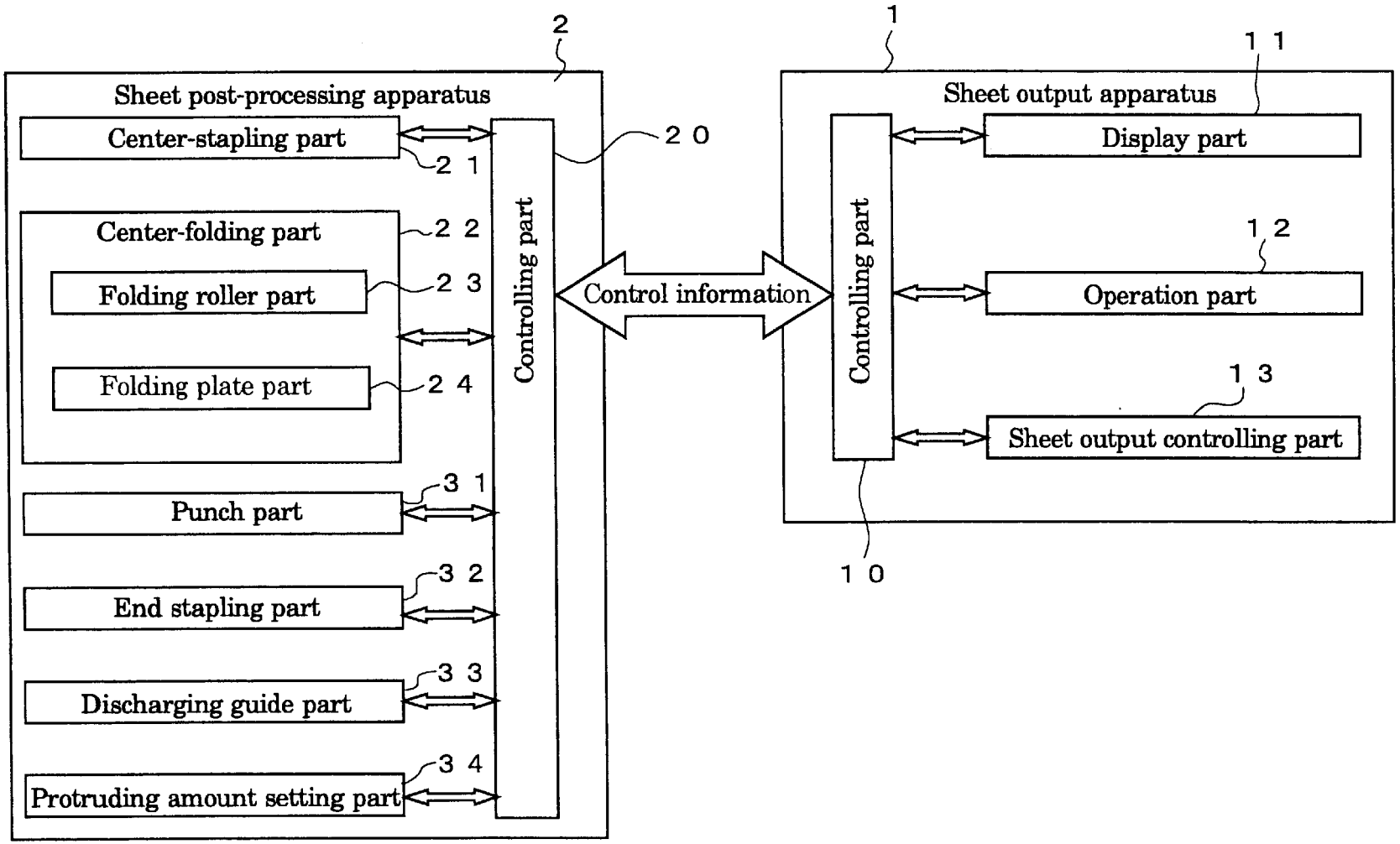
FIG. 30 is a block diagram showing a constitution overview of a sheet processing system provided with the sheet post-processing apparatus relating to the present embodiment.

FIG. 30 is a block diagram showing a constitution overview of the sheet processing system provided with the sheet post-processing apparatus relating to the present embodiment.

As described before, this system comprises the sheet post-processing apparatus 2 and the copying machine 1 (sheet output apparatus) to which the sheet post-processing apparatus 2 is connected. The individual apparatuses 1, 2 are provided with CPU's and accompanying controlling parts 10, 20 respectively provided with a ROM and a RAM. Sending/receiving processing information between them determines content of control for a center-stapling part 21 and a center-folding part 22 of the sheet post-processing apparatus 2. The sheet post-processing apparatus 2 is constituted in such a manner that the controlling part 20 controls the center-stapling part 21 and the center-folding part 22. The control for the center-folding part 22 further includes control for a folding roller part 23 and a folding plate part 24, the folding roller part 23 controls drive of the folding motor 453, and the folding plate part 24 controls drive of the folding plate driving motor 461.

The controlling part 20 also controls individual driving parts for a punch part 31, an end stapling part 32, and a discharging guide part 33. On the copying machine 1 side, the controlling part 10 controls a display part 11, an operation part 12, and a sheet output controlling part 13.

Figure 31:
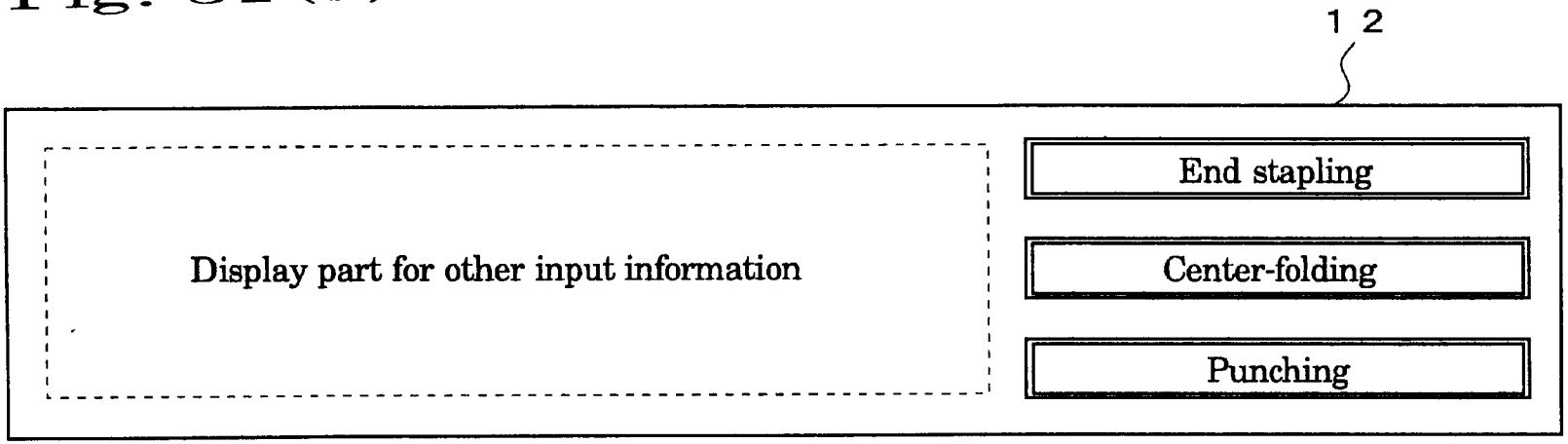
FIG. 31 shows a display state of an operation part for a user to enter the stapling and folding processes.
Figure 31:
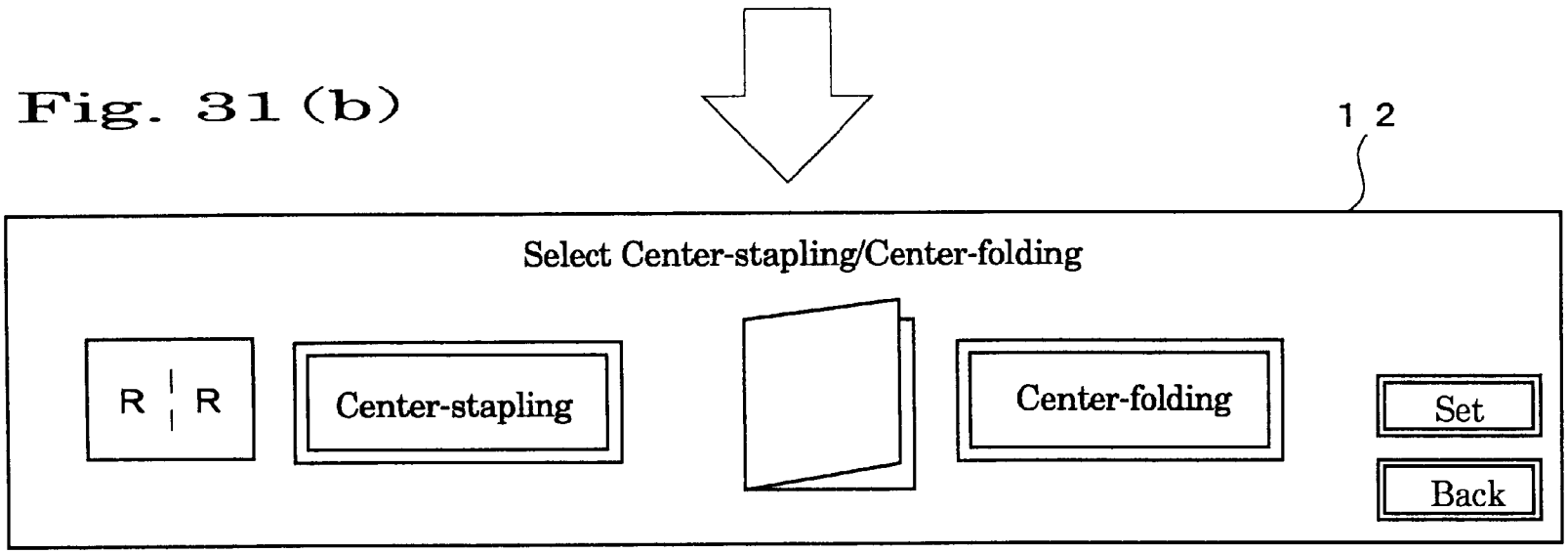

In this constitution, information provided for the operation part 12 of copying machine 1 is information for existence of the center-stapling and information for existence of the center-folding as shown in FIG. 31. The instruction information is selected by touching a desired display part on the operation part 12 as described later, and is transmitted to the sheet post-processing part. Based on the entered information, information on sheet size and processing mode is sent from the controlling part 10 of copying machine 1 to the controlling part 20 of sheet post-processing apparatus 2, and the controlling part 20 of sheet post-processing apparatus 2 controls the center-stapling part 21 and the center-folding part 22 based on the information.

2.2 Discharging Sheet Bundle after Folding at the Center

Figure 32:
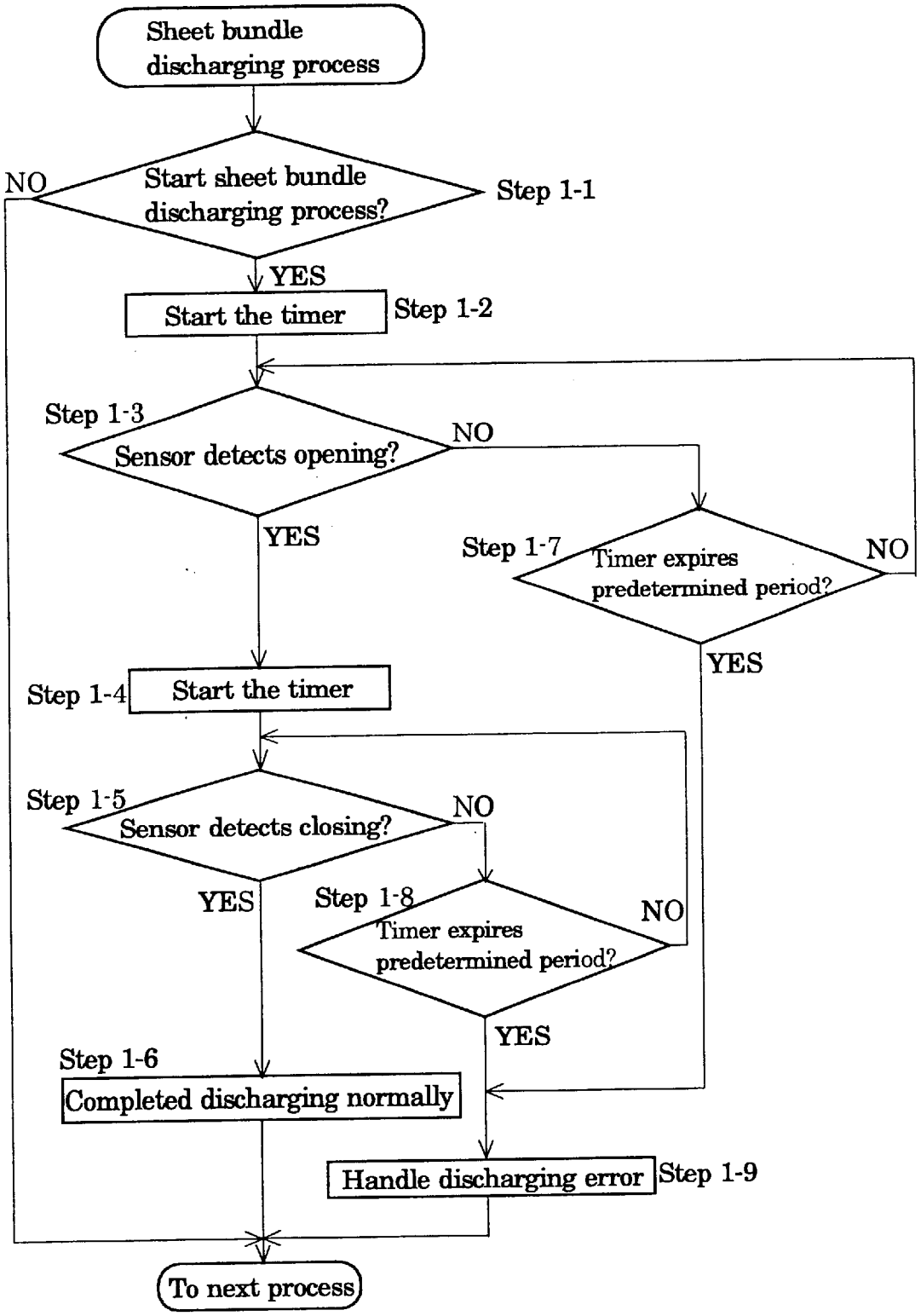
FIG. 32 is a flowchart describing a control procedure for discharging a sheet bundle after the sheet bundle is folded into two by a folding apparatus.

FIG. 32 is a flowchart describing a control procedure for discharging a sheet bundle after the sheet bundle is folded into two by the folding apparatus. The CPU suppressed from Figure showing the controlling part 20 of sheet post processing apparatus 2 conducts the processing following a program stored in the ROM suppressed from Figure. The controlling part 20 is provided with the RAM as well. The RAM serves as a work area when the CPU executes the program.

In this process, when a process for discharging a sheet bundle starts (Step 1-1), a timer for detecting a discharging error starts (Step 1-2), and the opening/closing sensor 313 of opening/closing end fence 311 is checked to confirm whether the fence is open (Step 1-3). After a predetermine time has passed (Step 1-7), if the opening of fence is not detected, it is determined that an error occurred in the discharging, and a discharging error handling is conducted (Step 1-9). When the opening of fence is detected in Step 1-3, the timer for detecting an error starts again (Step 1-4), and the opening/closing sensor 313 of opening/closing end fence 311 is checked to confirm whether the fence is closed (Step 1-5). After a predetermine time has passed (Step 1-8), if the closing of fence is not detected, it is determined that an error occurred in the discharging, and a discharging error handling is conducted (Step 1-9). When the closing of fence is detected in Step 1-5, it is determined that the sheet bundle was discharged normally, and the process proceeds to a next process.

Figure 33:
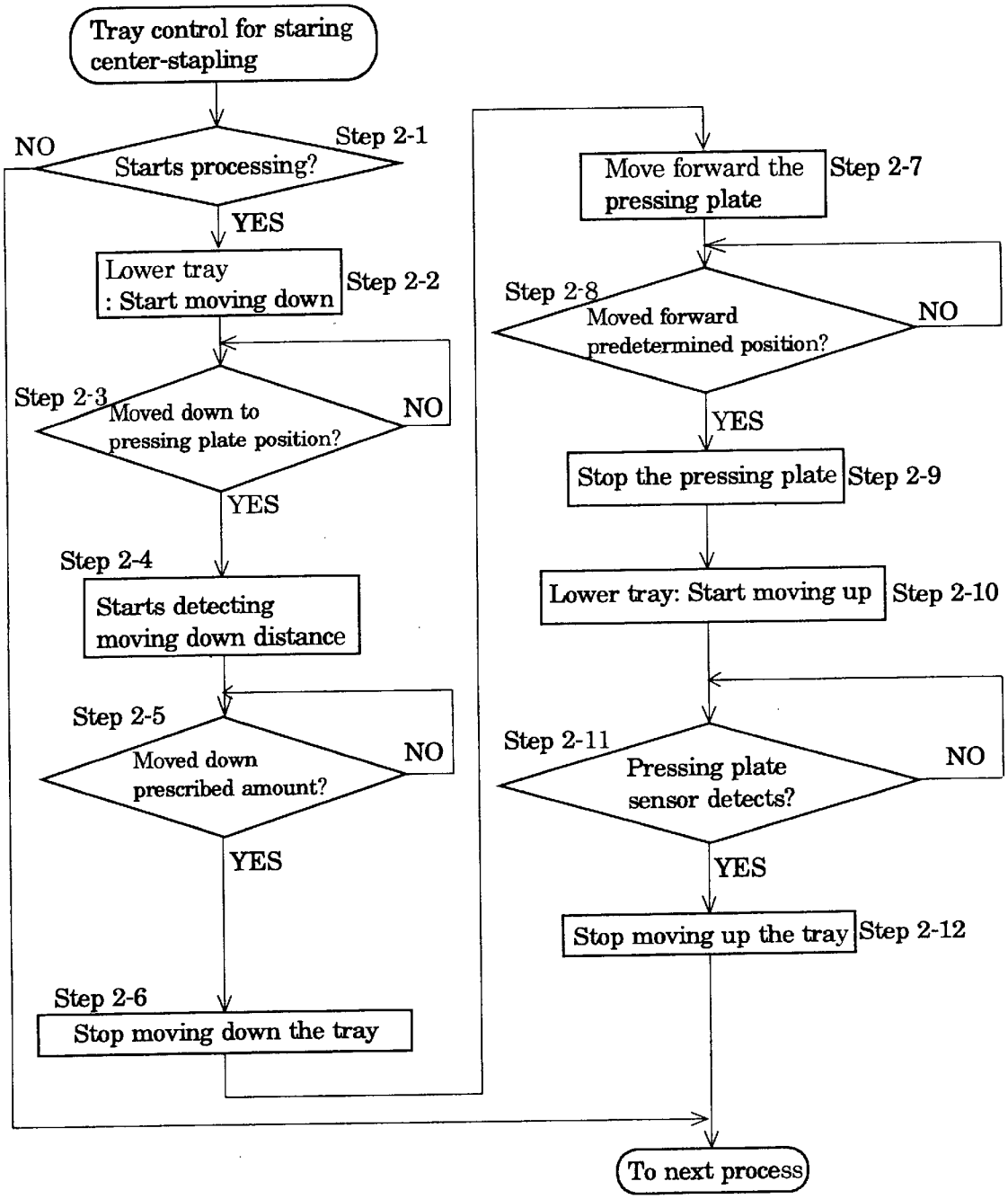
FIG. 33 is a flowchart describing a control procedure for moving control to a waiting position for the lower side stacking tray when the center-stapling process starts.

2.3 Controlling for the Lower Side Stacking Tray when the Center-stapling Process Starts FIG. 33 is a flowchart describing a control procedure for moving the lower side stacking tray 301 to the waiting position when the center-stapling process starts.

In this process, when the process starts (Step 2-1), the lower side stacking tray 301 starts moving down first (Step 2-2), and moves down to the position of pressing plate 343 (Step 2-3). In this state, a sensor suppressed from Figure detects the position of pressing plate 343. When the lower side stacking tray 301 moves down to the position of pressing plate 343, detection of the moving-down distance starts (Step 2-4). A driving motor for lifting up/down the lower side stacking tray 301, which is suppressed from Figure, is provided with an encoder, and the moving distance is easily detected. When the encoder detects that the lower side stacking tray 301 moves down a predetermined amount (Step 2-5), the tray stops moving down (Step 2-6, refer to FIG. 24(*b*)). A sufficient predetermined amount for moving down the tray is an amount to a position where an action of the pressing plate 343 is not interfered, and is set to about 20 mm in the present embodiment.

Immediately after the lower side stacking tray 301 stops moving down, the pressing plate 343 moves forward (Step 2-7), and when it moves forward to a predetermined position (Step 2-8), the pressing plate 343 stops (Step 2-9). When the pressing plate 343 stops, the lower side stacking tray 301 starts moving up immediately (Step 2-10), the state of pressing plate sensor 347 is checked (Step 2-11), if the pressing plate sensor 347 is in a detecting state, or, in other words, the pressing plate sensor 347 detects the motor fixing plate 342, the lower side stacking tray 301 stops moving up, (Step 2-12, FIG. 24(*c*)), and a state ready for center-stapling is entered.

Figure 34:
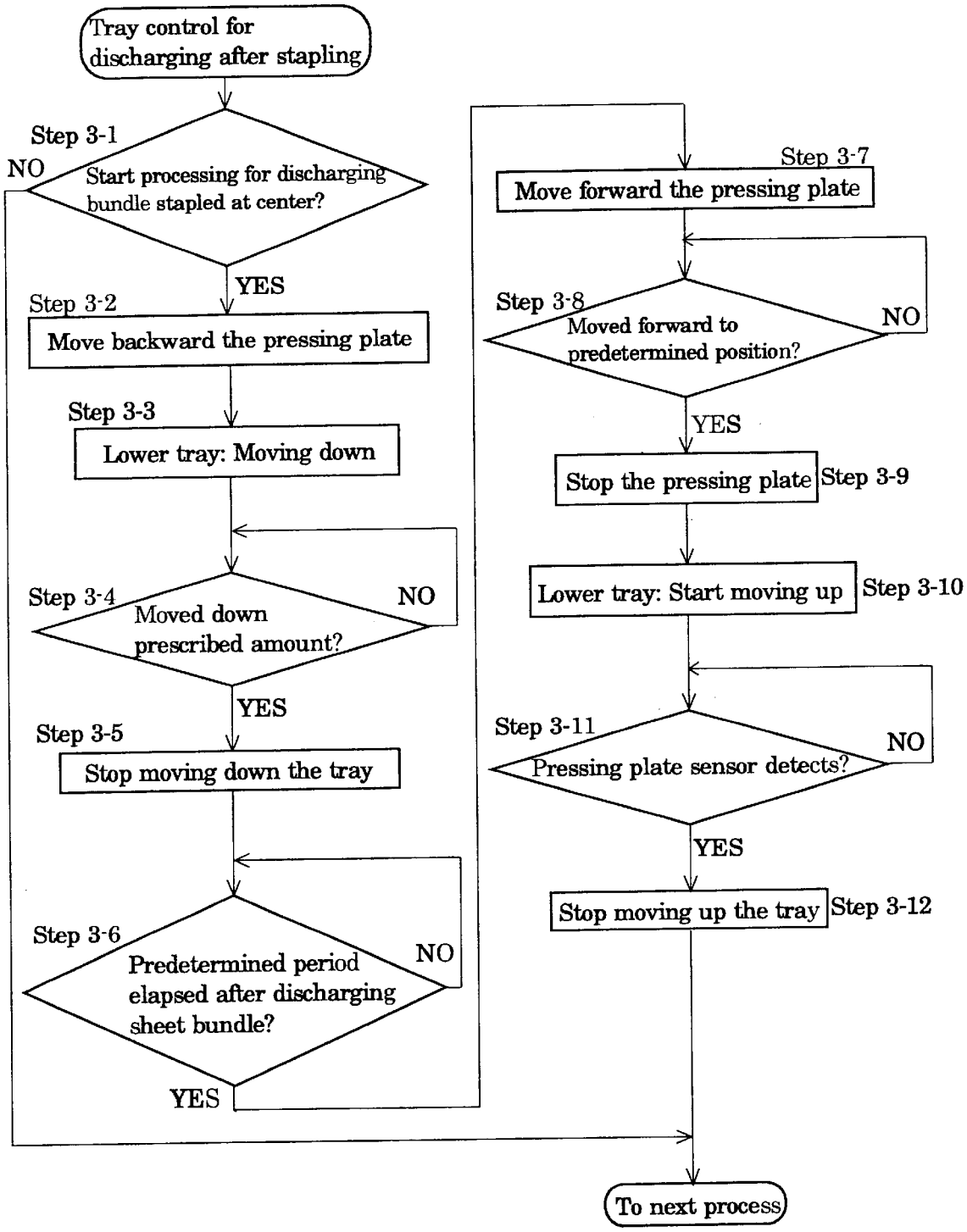
FIG. 34 is a flowchart describing a control procedure for the lower side stacking tray during discharging a stapled sheet bundle stapled at the center.

2.4 Controlling for the Lower Side Stacking Tray during Discharging a Sheet Bundle Stapled at the Center FIG. 34 is a flowchart describing a control procedure for the lower side stacking tray 301 during discharging a stapled sheet bundle stapled at the center.

When the discharging process starts (Step 3-1), the pressing plate 343 retracts to a home position (Step 3-2), the lower side stacking tray 301 starts moving down (Step 3-3), the tray continues moving down a predetermined amount (Step 3-4), and stops moving down after having moved down the predetermined distance (Step 3-5, FIG. 24(*b*)). A driving motor under the tray is provided with an encoder to detect the moving distance easily, and is controlled in such a manner that a bulge at a folded part is surely pressed by changing the amount for moving down according to the number of stapled sheets. In the present embodiment, the amount for moving down is set to about 20 mm for up to five stapled sheets, about 30 mm for six to ten stapled sheets, and 50 mm for eleven or more stapled sheets. Discharging the sheet bundle is monitored (Step 3-6), and the pressing plate 343 moves forward after a constant period from discharging (Step 3-7). The constant period is a time until a sheet bundle stably drops on the tray after discharging. In the present embodiment, the period is about two seconds after the opening/closing sensor 313 detect a discharge. When the pressing plate 343 moves forward to a predetermined position (Step 3-8), the pressing plate 343 stops (Step 3-9). A motor for driving the pressing plate 343 is a stepping motor, and impressing predetermined pulses moves the motor forward to a predetermined position. When the pressing plate 343 stops, the lower side stacking tray 301 starts moving up immediately (Step 3-10), the output of pressing plate sensor 342 is checked (Step 3-11), if the pressing plate sensor 347 detects the motor fixing plate 342, the lower side stacking tray 301 stops moving up (Step 3-12, refer to FIG. 24(*c*)), and a state ready for next process is entered.

According to claim 1 of the present invention, providing a discharging mean for discharging a sheet bundle folded into two by the center-folding mean from the side folded into two, and a turning-over mean for turning over in such a manner that the side folded at the center is oriented to the upstream side in sheet conveying direction after discharged from the discharging mean and before stacked on the sheet stacking tray, thereby realizes a stable stack state with a simple constitution, resulting in increasing the amount of stack.

Since a sheet bundle is stacked without providing a special stacking tray, the sheet tray is shared for a standard sheet which is not folded into two. Sharing the discharge tray for standard sheets eliminates increase of the size.

According to claim 2 of the present invention, the turning-over mean comprises a guide plate for forcing the front side of a sheet bundle discharged from the discharging mean orient downward, thereby turning over a sheet bundle with a simple constitution for stacking.

According to claim 3 of the present invention, the guide plate is urged to the closing direction with the predetermined urging force, thereby deflecting a sheet bundle according to the flexibility of sheet bundle.

According to claim 4 of the present invention, the maximum opening of guide plate is set to a predetermined angle, and the sheet bundle is deflected when the flexibility of sheet bundle is low.

According to claim 5 of the present invention, the guide plate is closed, and retracts to or beyond a face flush with a rear end fence with which a rear end side of a sheet bundle is in contact for a standard discharging without folding a sheet bundle into two, thereby eliminating an interference when the sheet stacking tray moves up/down.

According to claim 6 of the present invention, a mean is further provided for detecting open/closed state of the guide plate, thereby easily detecting an error in a turning over action.

According to claim 7 of the present invention, the discharging mean comprises a pair of discharging rollers, and the turning over mean comprises a driving control mean for driving the roller pair in such a manner that a peripheral speed of an upper side discharging roller is larger than a peripheral speed of a lower side roller, thereby easily turning over a sheet bundle only with the rotation control of discharging rollers.

According to claim 8 of the present invention, the turning-over mean comprises a mean for changing an angle of the stacking tray in such a manner that the angle of stacking tray is steeper than that for the standard discharging without folding a sheet bundle into two, thereby properly handling a case for the standard discharging and the case for a sheet bundle stapled at the center.

According to claim 9 of the present invention, the angle changing mean changes an angle of the stacking tray more than an angle sufficient for generating a slide in a downward direction of the front end on the side folded into two of a discharged bundle when the front end of sheet bundle comes in contact with the stacking tray or a top sheet face of stacked sheet bundles, thereby surely conducting a turning-over action.

According to claim 10 of the present invention, the angle changing mean changes only a part of the stacking tray, thereby surely conducing a turning-over action without increasing the size.

According to claim 11 of the present invention, the mean for changing an angle of only a part of the stacking tray comprises an auxiliary tray rising from the stacking tray with a predetermined position of the stacking tray as a fulcrum, thereby surely conducting a turning-over action without increasing the size.

According to claim 12 of the present invention, the predetermined position is set in a range of 40 mm 10 mm from the rear end fence, thereby surely conducting a turning-over action for sheet sizes usually used.

According to claim 1 of the present invention, the mean for raising the auxiliary tray comprises a cam mean operating according to the position of stacking tray, thereby easily and surely raising/returning the auxiliary tray in association with the position of stacking tray.

According to claim 14 of the present invention, a lifting mean for lifting up/down the stacking tray, and a stacking tray driving control mean for controlling drive of the lifting mean are provided, the stacking tray driving control mean moves the stacking tray from a standard discharging position for standard discharging without folding a sheet bundle into two to a predetermined lower position, and operates the cam mean to raise the auxiliary tray when a mode for discharging a sheet bundle folded into two is set, and the auxiliary tray rises automatically to surely conduct a turning-over operation when a sheet bundle folded into two is stacked.

According to claim 15 of the present invention, a lock mean for locking a position of an auxiliary tray when the auxiliary tray rises is provided, thereby surely turn over a sheet bundle if the stacked amount of sheet bundles on the auxiliary tray increases when the auxiliary tray rises.

According to claim 16 of the present invention, the lock mean is released when the stacking tray moves up from the predetermined position, thereby immediately handle a standard discharging above that position.

According to claim 17 of the present invention, the auxiliary tray does not rise due to the self-weight of sheets when the stacking tray moves to the predetermined lower position for standard discharging without folding a sheet bundle into two, thereby continuing the standard discharging without degrading the usability.

According to claim 18 of the present invention, an aligning mean for aligning the sheet bundles on the upstream side in a discharging direction of the stacking tray, and a pressing mean for pressing the sheet bundles stacked on the stacking tray on the aligned side are provided, thereby realizing a stable stack state with a simple constitution. This constitution increases the stacked amount.

Also a sheet bundle is stacked without providing a special stacking tray, and a stacking tray can be used as a discharging tray for a standard sheet, which is not folded into two. Since the tray is also used as a discharging tray for a standard sheet, the size does not increase.

According to claim 19 of the present invention, the aligning mean aligns a sheet bundle on a folded side of the sheet bundle, thereby preventing the sheet bundle from being displaced, resulting in aligning the sheet bundle neatly.

According to claim 20 of the present invention, the aligning mean is constituted with the stacking tray tilted in such a manner that the downstream side in a conveying direction is higher than the upstream side, and a rear end fence which supports the tilted stacking tray for lifting up/down and with which end edges of sheets discharged on the stacking tray comes in contact, thereby surely aligning the sheet bundle at the rear end fence using self-weight of the sheet bundle.

According to claim 21 of the present invention, the sheet bundle folded into two is discharged in such a manner that the folded side comes out first, and a turning-over mean is provided to turn over the sheet bundle so that the folded side is placed on the side of aligning mean, thereby surly aligning on the folded side.

According to claim 22 of the present invention, the aligning mean comprises a stacking tray which tilts in such a manner that the downstream side is higher than the upstream side in a conveying direction, and is supported for moving up/down, and a rear end fence with which end edges of sheets discharged on the stacking tray come in contact, and the pressing mean comprises a pressing member which comes in contact with a top face of the sheets, and a driving mean for protruding/retracting the pressing member from a face of the rear end fence with which the end edges of sheets come in contact, thereby allowing a pressing action while sheet bundles are in contact with the rear end fence, resulting in eliminating displacement of the sheet bundles.

According to claim 23 of the present invention, the protruding/retracting action of pressing member is conducted linearly, thereby allowing constituting a driving mechanism with a simple mechanism.

According to claim 24 of the present invention, the pressing member is set to protrude at an upward angle against a sheet stacking face of the stacking tray when the pressing member protrudes, and to maintain a downward angle against the sheet stacking face of stacking tray when the pressing member fully protrudes, thereby avoiding an interference with sheet bundles already stacked during the protruding action, and ensuring a secure pressing action during the pressing action.

According to claim 25 of the present invention, a lifting mean for lifting up/down the stacking tray is provided, and the lifting mean lifts up the stacking tray while the pressing member is protruding over sheet bundles on the stacking tray, and the sheet bundles are clamped between the pressing member and the stacking tray, thereby eliminating a necessity of providing an independent pressing mean, resulting in applying the lifting mean originally provided for the stacking tray to pressing sheets.

According to claim 26 of the present invention, a detecting mean is provided for detecting the pressing force for pressing the sheet bundles, and the lifting mean stops a lifting up action when the detecting mean detects that the pressing force exceeds a predetermined value, thereby always pressing sheet bundles with a constant pressing force.

According to claim 27 of the present invention, an angle between a protruding direction of the pressing member and a stacking face of the stacking tray is set as $\theta f \geqq \theta t$ when the lifting mean stops lifting up the stacking tray where $\theta f$ is an angle between the pressing member and the rear end fence at a discharging side of a sheet bundle, and $\theta t$ is an angle between the stacking tray and the rear end fence also at the discharging side of a sheet bundle, thereby pressing a sheet bundle with the pressing member without displacing the sheet bundle due to a bulge near a stapled position.

According to claim 28 of the present invention, the detecting mean comprises an urging mean urging a member for supporting the pressing member toward a direction resisting against a lifting up action of the lifting mean, and a position detecting mean for detecting a position of the member for supporting, and the detecting mean detects whether a pressing force exceeds a predetermined value according to a position of the member for supporting detected by the position detecting mean, thereby directly and surely detecting whether the pressing force exceeds the predetermined value.

According to claim 29 of the present invention, the discharging mean discharges the sheet bundle while the pressing member is protruding, thereby placing the sheet bundle in a turned-over state on a top face of the pressing member.

According to claim 30 of the present invention, the discharging mean discharges the sheet bundle, the sheet bundle is placed on the top face of pressing member, and then the pressing member retracts inside the rear end fence, thereby placing a new sheet bundle on the sheet bundles stacked below the pressing member after the new sheet bundle is aligned with the rear end fence.

According to claim 31 of the present invention, the stacking tray moves down a predetermined amount after the pressing member retracts inside the rear end fence, thereby preventing the pressing member from displacing sheet bundles already stacked.

According to claim 32 of the present invention, the moving-down amount is set variably according to number of sheets to be stapled, thereby eliminating a useless motion, resulting in an efficient processing.

According to claim 33 of the present invention, the turning-over mean comprises an angle-changing mean for changing an angle of the stacking tray in such a manner that the angle of stacking tray is steeper than that for a standard discharging without folding a sheet bundle into two, thereby surely conducting the turning-over action only by changing the angle of stacking tray, resulting in orienting stapled side toward the rear end fence.

According to claim 34 of the present invention, the angle changing mean comprises an auxiliary tray rising from the stacking tray with a predetermined position of the stacking tray as a fulcrum, thereby constituting the turning-over mean with a simple mechanism without increasing the size.

According to claim 35 of the present invention, the predetermined position is set in a range of 40 mm 10 mm from the lowest end position of sheet bundle stacking face of the stacking tray, thereby surely conducting the turning-over action for sheet sizes usually used.

According to claim 36 of the present invention, a protruding amount when the protruding member protrudes is set to a distance approximately equivalent to a distance between the fulcrum of auxiliary tray rising from the stacking tray with the predetermined position on the stacking tray as the fulcrum, and the lowest end position of sheet bundle stacking face of stacking tray, and is correlated with a position where the sheet bundles bends when the angle changes, thereby preventing the pressing member from interfering with the bent (angled) position of sheet bundles, resulting in surly pressing sheet bundles.

According to claim 37 of the present invention, a protruding amount of the pressing member decreases according to the increase of stacked number of sheet bundles stacked on the stacking tray, thereby preventing the pressing member from interfering with a bent (angled) position of the sheet bundles, thereby surly pressing sheet bundles.

According to claim 38 of the present invention, a protruding amount when the protruding member protrudes is variably set to stapled sheet number, thereby handling change of a bulging position, which depends on stapled thickness, resulting in surely pressing sheet bundles without displacing them.

According to claim 39 of the present invention, the pressing member presses a predetermined range symmetrical about the center of sheet bundles, thereby preventing a stack state of the sheet bundles from being destabilized, resulting in stacking more sheet bundles.

According to claim 40 of the present invention, multiple pressing members are provided to press positions symmetrical about the center of sheet bundles, thereby preventing a stack state of the sheet bundles from being destabilized, resulting in stacking more sheet bundles.

According to claim 41 of the present invention, coefficient of friction on a top face is set to higher than that on a bottom face of the pressing member to prevent displacement of a stack state of sheet bundles stacked under the pressing member when the pressing member is protruding, and to make a sheet bundle on a top face side in contact with the rear end fence when the pressing member is retracting into the rear end fence for a better alignment.

According to claim 42 of the present invention, a roller rotational at least when the pressing member is protruding is provided on a tip of the pressing member, thereby preventing displacement of a stack state of sheet bundles stacked under the pressing member when the pressing member is protruding.

According to claim 43 of the present invention, a stacking tray driving control mean for moving the stacking tray from a standard discharging position for discharging a sheet bundle without folding into two to a predetermined lower position shorter than a sheet bundle conveying distance when a mode for discharging a sheet bundle folded into two is selected, and a guide mean for deflecting downward a front end of a sheet bundle folded into two after being discharged from the discharging mean are provided, the guide mean leads the front end of sheet bundle folded into two to the stacking tray or a top face of stacked sheet bundles to make them in contact with each other, the discharging mean maintains the discharging action to turn over the sheet bundle, and the sheet bundle is placed on the sheet upper side stacking tray, thereby conducting turned-over discharging while a sheet bundle is constrained, resulting in providing an effect equivalent to the invention described in claim 1.

According to claim 44 of the present invention, the turning-over mean is constituted with a member for pushing a part at least closer to a rear end side than to the front end of sheet bundle to push out a non-stapled side toward the downstream side in a discharging direction when the front end on the side folded into two of the sheet bundle comes in contact with the stacking tray or a top sheet face of sheet bundles stacked on the stacking tray, thereby easily and surely turning over the sheet bundle.

According to claim 45 of the present invention, a first controlling mean for controlling individual parts of the sheet processing apparatus, and a second controlling mean for mutually communicating with the first controlling mean, sending control information to the first controlling mean, and controlling individual parts of the image forming apparatus are provided, the sheet processing apparatus uses the turning-over mean to turn over a sheet bundle, and stacks the sheet bundle on the stacking tray when both center-stapling mode and center-folding mode are set from the image forming apparatus, the sheet processing apparatus surely conducts a turning-over and placing action for a sheet bundle according to the mode setting from the image forming apparatus, resulting in providing an effect equivalent to that of the invention described in claim 1.

According to claim 46 of the present invention, a first controlling mean for controlling individual parts of the sheet processing apparatus, and a second controlling mean for mutually communicating with the first controlling mean, sending control information to the first controlling mean, and controlling constituting elements of the image forming apparatus are provided, the stacking tray for stacking discharged sheet moves down to the predetermined position lower than the position where the pressing plate is provided for pressing sheet bundles stacked on the stacking tray on the aligning end side when both center-stapling mode and center-folding mode are set from the image forming apparatus, a sheet bundle is turned over by the turning-over mean set on the sheet processing apparatus to stack the sheet bundle on the stacking tray, and the pressing plate and the stacking tray press the sheet bundle on the stapled side, resulting in providing an effect equivalent to that of the invention described in claim 1.

According to claim 47 of the present invention, when a sheet bundle is stacked on a stacking tray after the sheet bundle is folded into two at the center, dropping direction of the sheet bundle is restricted to a predetermined direction, a tilting angle of the stacking tray is set so that a front end on the folded side of dropped sheet bundle is placed on the lower side of tilted stacking tray, and the sheet bundle is turned over and stacked on the stacking tray, resulting in providing an effect equivalent to that of the invention described in claim 1.

According to claim 48 of the present invention, when the sheet bundle is being stacked on a stacking tray after a sheet bundle is folded into two at the center, the sheet bundle is turned over and is aligned on a stapled side, a pressing plate protrudes over aligned sheet bundles, the stacking tray lifts up while the pressing plate is pressing a top face of the sheet bundles, a bulge of the sheet bundles is restrained by applying a predetermined pressing force between the pressing plate and the stacking tray to stack aligned sheet bundles on the stacking tray, resulting in providing an effect equivalent to that of the invention described in claim 1.

What is claimed is:

1. A sheet processing apparatus comprising:

a center-stapling means for stapling the center of a sheet bundle made up of sheets conveyed from a sheet output apparatus;

a center-folding means for folding the stapled sheet bundle into two;

a discharging means for discharging the sheet bundle folded into two in such a manner that the side folded into two is discharged first;

a turning-over means for turning over a sheet bundle discharged from the discharging means so that the side folded at the center is oriented to the upstream side in a sheet conveying direction; and a stacking tray for stacking the sheet bundle discharged from the discharging means and turned over by the turning over means.

2. The sheet processing apparatus as claimed in claim 1, wherein the turning-over means comprises a guide plate for forcing the front side of a sheet bundle discharged from the discharging means to orient downward for discharging.

3. The sheet processing apparatus as claimed in claim 2, wherein the guide plate is urged toward a closing direction with a predetermined urging force.

4. The sheet processing apparatus as claimed in claim 2, wherein a maximum opening of the guide plate is set to a predetermined angle.

5. The sheet processing apparatus as claimed in claim 2, wherein the guide plate is closed, and retracts to or beyond a face flush with a rear end fence with which a rear end side of a sheet bundle is in contact for a standard discharging without folding a sheet bundle into two.

6. The sheet processing apparatus as claimed in claim 2 further comprises a means for detecting open/closed state of the guide plate.

7. The sheet processing apparatus as claimed in claim 1, wherein the discharging means comprises a pair of discharging rollers, and the turning over means comprises a driving control means for driving the roller pair in such a manner that a peripheral speed of an upper side discharging roller is larger than a peripheral speed of a lower side roller.

8. The sheet processing apparatus as claimed in claim 1, wherein the turning-over means comprises a means for changing an angle of the stacking tray in such a manner that the angle of the stacking tray is steeper than that for standard discharging without folding a sheet bundle into two.

9. The sheet processing apparatus as claimed in claim 8, wherein the angle changing means changes an angle of the stacking tray more than an angle sufficient for generating a slide in a downward direction of a front end on the side folded into two of a discharged bundle when the front end of the sheet bundle comes in contact with the stacking tray or a top sheet face of stacked sheet bundles.

10. The sheet processing apparatus as claimed in claim 8, wherein the angle changing means changes only a part of the stacking tray.

11. The sheet processing apparatus as claimed in claim 10, wherein the means for changing an angle of only a part of the stacking tray comprises means for raising an auxiliary tray from the stacking tray with a predetermined position of the stacking tray as a fulcrum.

12. The sheet processing apparatus as claimed in claim 11, wherein the predetermined position is set in a range of 40 mm to 10 mm from the rear end fence.

13. The sheet processing apparatus as claimed in claim 11, wherein the means for raising the auxiliary tray comprises a cam means operating according to the position of stacking tray.

14. The sheet processing apparatus as claimed in claim 13 further comprising:

a lifting means for lifting up/down the stacking tray; and a stacking tray driving control means for controlling drive of the lifting means;

wherein the stacking tray driving control means moves the stacking tray from a standard discharging position for standard discharging without folding a sheet bundle into two to a predetermined lower position, and operates the cam means to raise the auxiliary tray when a mode for discharging a sheet bundle folded into two is set.

15. The sheet processing apparatus as claimed in claim 14 further comprising:

a lock means for locking a position of an auxiliary tray when the auxiliary tray rises.

16. The sheet processing apparatus as claimed in claim 15, wherein the lock means is released when the stacking tray moves up from the predetermined position.

17. The sheet processing apparatus as claimed in claim 13, wherein the auxiliary tray does not rise due to the self-weight of sheets when the stacking tray moves to the predetermined lower position for standard discharging without folding a sheet bundle into two.

18. A sheet processing apparatus comprising:

a center-stapling means for stapling the center of a sheet bundle made up of sheets conveyed from a sheet output apparatus;

a center-folding means for folding the stapled sheet bundle into two;

a discharging means for discharging the sheet bundle folded into two;

a stacking tray for stacking the sheet bundle discharged from the discharging means;

an aligning means for aligning the sheet bundles on an upstream side in a discharging direction of the stacking tray;

a pressing means for pressing the sheet bundles stacked on the stacking tray on the aligned side; and a driving means for protruding/retracting the pressing means from a pressing position.

19. The sheet processing apparatus as claimed in claim 18, wherein the aligning means aligns a sheet bundle on a folded side of the sheet bundle.

20. The sheet processing apparatus as claimed in claim 18, wherein the aligning means comprises the stacking tray tilted in such a manner that a downstream side in a conveying direction is higher than the upstream side, and a rear end fence which supports the tilted stacking tray for lifting up/down and with which an end edge of sheets discharged on the stacking tray comes in contact.

21. The sheet processing apparatus as claimed in claim 18 further comprising:

a turning-over means for turning over the sheet bundle so that the folded side is placed on the side of the aligning means;

wherein the sheet bundle folded into two is discharged in such a manner that the folded side comes out first.

22. The sheet processing apparatus as claimed in claim 18, wherein the aligning means comprises a stacking tray which tilts in such a manner that the downstream side is higher than the upstream side in a conveying direction, and is supported for moving up/down and a rear end fence with which end edges of sheets discharged on the stacking tray come in contact, and the pressing means comprises a pressing member which comes in contact with a top face of the sheets, and the driving means for protruding/retracting the pressing member from a face of the rear end fence with which the end edges of sheets come in contact.

23. The sheet protecting apparatus as claimed in claim 22, wherein the protruding/retracting action of the pressing member is conducted linearly.

24. The sheet processing apparatus as claimed in claim 22, wherein the pressing member is set to protrude at an upward angle against a sheet stacking face of the stacking tray when the pressing member protrudes, and to maintain a downward angle against the sheet stacking face of stacking tray when the pressing member fully protrudes.

25. The sheet processing apparatus as claimed in claim 22 further comprising a lifting means for lifting up/down the stacking tray, wherein the lifting means lifts up the stacking tray while the pressing member is protruding over sheet bundles on the stacking tray, and the sheet bundles are clamped between the pressing member and the stacking tray.

26. The sheet processing apparatus as claimed in claim 25 further comprising:

a detecting means for detecting the pressing force for pressing the sheet bundles, wherein the lifting means stops a lifting up action when the detecting means detects that the pressing force exceeds a predetermined value.

27. The sheet processing apparatus as claimed in claim 26, wherein an angle between a protruding direction of the pressing member and a stacking face of the stacking tray is set as:

$$\theta f \geqq \theta t$$

when the lifting means stops lifting up the stacking tray, where θf is an angle between the pressing member and the rear end fence at a discharging side of a sheet bundle, and θt is an angle between the stacking tray and the rear end fence also at the discharging side of a sheet bundle.

28. The sheet processing apparatus as claimed in claim 25, wherein the detecting means comprises an urging means urging a member for supporting the pressing member toward a direction resisting against a lifting up action of the lifting means, and a position detecting means for detecting a position of the member for supporting, and the detecting means detects whether a pressing force exceeds a predetermined value according to a position of the member for supporting detected by the position detecting means.

29. The sheet processing apparatus as claimed in claim 22, wherein the discharging means discharges the sheet bundle while the pressing member is protruding.

30. The sheet processing apparatus as claimed in claim 29, wherein the discharging means discharges the sheet bundle, the sheet bundle is placed on a top face of pressing member, and then the driving means retracts the pressing member inside the rear end fence.

31. The sheet processing apparatus as claimed in claim 30, wherein the lifting means moves down the stacking tray a predetermined amount after the pressing member retracts inside the rear end fence.

32. The sheet processing apparatus as claimed in claim 31, wherein the moving-down amount is set variably according to number of sheets to be stapled.

33. The sheet processing apparatus as claimed in claim 21, wherein the turning-over means comprises an angle changing means for changing an angle of the stacking tray in such a manner that the angle of stacking tray is steeper than that for a standard discharging without folding a sheet bundle into two.

34. The sheet processing apparatus as claimed in claim 33, wherein the angle changing means comprises an auxiliary tray rising from the stacking tray with a predetermined position of the stacking tray as a fulcrum.

35. The sheet processing apparatus as claimed in claim 34, wherein the predetermined position is set in a range of 40 mm to 10 mm from the lowest end position of sheet bundle stacking face of stacking tray.

36. The sheet processing apparatus as claimed in claim 22, wherein a pressing amount when the pressing member protrudes is set to a distance approximately equivalent to a distance between the fulcrum of auxiliary tray rising from the stacking tray with the predetermined position on the stacking tray as the fulcrum, and the lowest end position of sheet bundle stacking face of stacking tray.

37. The sheet processing apparatus as claimed in claim 22, wherein a protruding amount of the pressing member decreases according to an increase of stacked number of sheet bundles stacked on the stacking tray.

38. The sheet processing apparatus as claimed in claim 22, wherein a pressing amount when the pressing member protrudes is variably set to a stapled sheet number.

39. The sheet processing apparatus as claimed in claim 22, wherein the pressing member presses a predetermined range symmetrical about a center of sheet bundles.

40. The sheet processing apparatus as claimed in claim 22, wherein multiple pressing members are provided to press positions symmetrical about a center of sheet bundles.

41. The sheet processing apparatus as claimed in claim 22, wherein a coefficient of friction on a top face is set to higher than that on a bottom face of the pressing member.

42. The sheet processing apparatus as claimed in claim 22, wherein a roller rotational, when the pressing member is protruding, is provided on a tip of the pressing member.

43. A sheet processing apparatus comprising;

a center-stapling means for stapling the center of a sheet bundle conveyed from a sheet output apparatus;

a center-folding means for folding the stapled sheet bundle into two;

a discharging means for discharging the sheet bundle folded into two in such a manner that the side folded into two is discharged first;

a stacking tray for stacking a sheet or sheet bundle discharged from the discharging means;

a lifting means for lifting up/down the stacking tray;

a stacking tray driving control means for controlling drive of the lifting means, and moving the stacking tray from a standard discharging position for discharging a sheet bundle without folding into two to a predetermined lower position shorter than a sheet bundle conveying distance when a mode for discharging a sheet bundle folded into two is selected; and a guide means for deflecting downward a front end of a sheet bundle folded into two after being discharged from the discharging means, wherein the guide means leads the front end of sheet bundle folded into two to the stacking tray or a top face of stacked sheet bundles to make them in contact with each other, the discharging means maintains the discharging action to turn over the sheet bundle, and the sheet bundle is placed on the stacking tray.

44. The sheet processing apparatus as claimed in claim 43, further comprising a turning-over means having a member for pushing a part at least closer to a rear end than to the front end of a sheet bundle to push out a non-stapled side toward a downstream side in a discharging direction when the front end on the side folded into two of the sheet bundle comes in contact with the stacking tray or a top sheet face of sheet bundles stacked on the stacking tray.

45. An image forming system comprising:

an image forming apparatus including an image forming means for forming an image based on provided image data, and an input means for allowing a user to select at least the center-stapling mode for stapling a sheet bundle at the center, and the center-folding mode for folding a sheet bundle at the center into two;

a sheet processing apparatus described in claim 1, which uses the turning-over means to turn over a sheet bundle, and stacks the sheet bundle on the stacking tray when the both center-stapling mode and the center-folding mode are set from the image forming apparatus;

a first controlling means for controlling individual parts of the sheet processing apparatus; and a second controlling means for mutually communicating with the first controlling means, sending control information to the first controlling means, and controlling individual parts of the image forming apparatus, wherein a process is applied to the sheet bundle made up of sheets discharged from the image forming apparatus.

46. An image forming system comprising;

an image forming apparatus including an image forming means for forming an image based on provided image data, and an input means for allowing a user to select at least the center-stapling mode for stapling a sheet bundle at the center, and the center-folding mode for folding a sheet bundle at the center into two;

a sheet processing apparatus described in claim 18, which moves down the stacking tray for stacking discharged sheet to the predetermined position lower than the position where the pressing plate is provided for pressing sheet bundles stacked on the stacking tray on the aligning end side, uses the turning-over means set on the sheet processing apparatus to turn over a sheet bundle, and to stack the sheet bundle on the stacking tray, and presses the sheet bundles on the stapled side between the pressing plate and the stacking tray when both center-stapling mode and center-folding mode are set from the image forming apparatus;

a first controlling means for controlling individual parts of the sheet processing apparatus; and a second controlling means for mutually communicating with the first controlling means, sending control information to the first controlling means, and controlling individual parts of the image forming apparatus, wherein a predetermined process is applied to the sheet bundle made up of sheets discharged from the image forming apparatus.

47. A sheet processing method for folding a sheet bundle stapled at the center of sheets into two at the same center, and stacking the sheet bundle on a predetermined stacking tray comprising steps of:

folding the sheet bundle into two at the center;

restricting dropping direction of the sheet bundle to a predetermined direction;

setting a tilting angle of the stacking tray so that a front end on the folded side of the dropped sheet bundle is placed on the lower side of tilted stacking tray;

turning over the sheet bundle; and stacking the sheet bundle on the stacking tray.

48. A sheet processing method for folding a sheet bundle stapled at the center of sheets into two at the same center, and stacking the sheet bundle on a predetermined stacking tray comprising steps of:

folding a sheet bundle into two at the center;

turning over the sheet bundle;

aligning the sheet bundle on a stapled side;

protruding a pressing plate over aligned sheet bundles;

lifting up the stacking tray while pressing a top face of the sheet bundles with the pressing plate;

applying a predetermined pressing force between the pressing plate and the stacking tray to restrain a bulge of the sheet bundles; and stacking aligned sheet bundles on the stacking tray.

49. A sheet processing apparatus comprising:

a center-stapling device configured to staple the center of a sheet bundle made up of sheets conveyed from a sheet output apparatus;

a center-folding device configured to fold the stapled sheet bundle into two;

a discharging device configured to discharge the sheet bundle folded into two in such a manner that the side folded into two is discharged first;

a turning-over device configured to turn over a sheet bundle discharged from the discharging device so that the side folded at the center is oriented to the upstream side in a sheet conveying direction; and a stacking tray configured to stack the sheet bundle discharged from the discharging device and turned over by the turning over device.

50. The sheet processing apparatus as claimed in claim 49, wherein the turning-over device comprises a guide plate for forcing the front side of a sheet bundle discharged from the discharging device to orient downward for discharging.

51. The sheet processing apparatus as claimed in claim 50, wherein the guide plate is urged towards closing direction with a predetermined urging force.

52. The sheet processing apparatus as claimed in claim 50, wherein a maximum opening of the guide plate is set to a predetermined angle.

53. The sheet processing apparatus as claimed in claim 50, wherein the guide plate is closed, and retracts to or beyond a face flush with a rear end fence with which a rear end side of a sheet bundle is in contact for a standard discharging without folding a sheet bundle into two.

54. The sheet processing apparatus as claimed in claim 50 further comprises a detecting device configured to detect an open/closed state of the guide plate.

55. The sheet processing apparatus as claimed in claim 49, wherein the discharging device comprises a pair of discharging rollers, and the turning over device comprises a driving control device configured to drive the roller pair in such a manner that a peripheral speed of an upper side discharging roller is larger than a peripheral speed of a lower side roller.

56. The sheet processing apparatus as claimed in claim 49, wherein the turning-over device comprises an angle changing device configured to change an angle of the stacking tray in such a manner that the angle of the stacking tray is steeper than that for standard discharging without folding a sheet bundle into two.

57. The sheet processing apparatus as claimed in claim 56, wherein the angle changing device is configured to change an angle of the stacking tray more than an angle sufficient for generating a slide in a downward direction of a front end on the side folded into two of a discharged bundle when the front end of the sheet bundle comes in contact with the stacking tray or a top sheet face of stacked sheet bundles.

58. The sheet processing apparatus as claimed in claim 56, wherein the angle changing device is configured to change only a part of the stacking tray.

59. The sheet processing apparatus as claimed in claim 58, wherein the angle changing device configured to change an angle of only a part of the stacking tray comprises a raising device configured to raise an auxiliary tray from the stacking tray with a predetermined position of the stacking tray as a fulcrum.

60. The sheet processing apparatus as claimed in claim 59, wherein the predetermined position is set in a range of 40 mm to 10 mm from the rear end fence.

61. The sheet processing apparatus as claimed in claim 59, wherein the raising device configured to raise the auxiliary tray comprises a cam device configured to operate according to the position of stacking tray.

62. The sheet processing apparatus as claimed in claim 61 further comprising:

a lifting device configured to lift up/down the stacking tray; and a stacking tray driving control device configured to control drive of the lifting device;

wherein the stacking tray driving control device is configured to move the stacking tray from a standard discharging position for standard discharging without folding a sheet bundle into two to a predetermined lower position, and to operate the cam device to raise the auxiliary tray when a mode for discharging a sheet bundle folded into two is set.

63. The sheet processing apparatus as claimed in claim 62 further comprising:

a lock device configured to lock a position of an auxiliary tray when the auxiliary tray rises.

64. The sheet processing apparatus as claimed in claim 63, wherein the lock device is released when the stacking tray moves up from the predetermined position.

65. The sheet processing apparatus as claimed in claim 62, wherein the auxiliary tray is configured to not rise due to the self-weight of sheets when the stacking tray moves to the predetermined lower position for standard discharging without folding a sheet bundle into two.

66. A sheet processing apparatus comprising:

a center-stapling device configured to staple the center of a sheet bundle made up of sheets conveyed from a sheet output apparatus;

a center-folding device configured to fold the stapled sheet bundle into two;

a discharging device configured to discharge the sheet bundle folded into two;

a stacking tray configured to stack the sheet bundle discharged from the discharging device;

an aligning device configured to aligning the sheet bundles on an upstream side in a discharging direction of the stacking tray;

a pressing device configured to press the sheet bundles stacked on the stacking tray on the aligned side; and a driving device configured to protrude/retract the pressing device from a pressing position.

67. The sheet processing apparatus as claimed in claim 66, wherein the aligning device is configured to align a sheet bundle on a folded side of the sheet bundle.

68. The sheet processing apparatus as claimed in claim 66, wherein the aligning device comprises the stacking tray tilted in such a manner that a downstream side in a conveying direction is higher than the upstream side, and a rear end fence which supports the tilted stacking tray for lifting up/down and with which an end edge of sheets discharged on the stacking tray comes in contact.

69. The sheet processing apparatus as claimed in claim 66 further comprising:

a turning-over device configured to turn over the sheet bundle so that the folded side is placed on the side of the aligning device;

wherein the sheet bundle folded into two is discharged in such a manner that the folded side comes out first.

70. The sheet processing apparatus as claimed in claim 66, wherein:

the aligning device comprises a stacking tray that tilts in such a manner that the downstream side is higher than the upstream side in a conveying direction, and is supported for moving up/down, and a rear end fence with which end edges of sheets discharged on the stacking tray come in contact;

and the pressing device comprises a pressing member that comes in contact with a top face of the sheets, and the driving device configured to for protrude/retract the pressing member from a face of the rear end fence with which the end edges of sheets come in contact.

71. The sheet protecting apparatus as claimed in claim 70, wherein the protruding/retracting action of the pressing member is conducted linearly.

72. The sheet processing apparatus as claimed in claim 70, wherein the pressing member is set to protrude at an upward angle against a sheet stacking face of the stacking tray when the pressing member protrudes, and to maintain a downward angle against the sheet stacking face of stacking tray when the pressing member fully protrudes.

73. The sheet processing apparatus as claimed in claim 70 further comprising a lifting device configured to lifting up/down the stacking tray, wherein the lifting device lifts up the stacking tray while the pressing member is protruding over sheet bundles on the stacking tray, and the sheet bundles are clamped between the pressing member and the stacking tray.

74. The sheet processing apparatus as claimed in claim 73 further comprising:

a detecting device configured to detecting the pressing force for pressing the sheet bundles, wherein the lifting device stops a lifting up action when the detecting device detects that the pressing force exceeds a predetermined value.

75. The sheet processing apparatus as claimed in claim 74, wherein an angle between a protruding direction of the pressing member and a stacking face of the stacking tray is set as:

$$\theta f \geqq \theta t$$

when the lifting device stops lifting up the stacking tray, where θf is an angle between the pressing member and the rear end fence at a discharging side of a sheet bundle, and θt is an angle between the stacking tray and the rear end fence also at the discharging side of a sheet bundle.

76. The sheet processing apparatus as claimed in claim 73, wherein the detecting device comprises:

an urging device configured to urge a member for supporting the pressing member toward a direction resisting against a lifting up action of the lifting device, and a position detecting device configured to detect a position of the member for supporting, and the detecting device is configured to detect whether a pressing force exceeds a predetermined value according to a position of the member for supporting detected by the position detecting device.

77. The sheet processing apparatus as claimed in claim 70, wherein the discharging device is configured to discharge the sheet bundle while the pressing member is protruding.

78. The sheet processing apparatus as claimed in claim 77, wherein the discharging device discharges the sheet bundle, the sheet bundle is placed on a top face of pressing member, and then the driving device retracts the pressing member inside the rear end fence.

79. The sheet processing apparatus as claimed in claim 78, wherein the lifting device is configured to move down the stacking tray a predetermined amount after the pressing member retracts inside the rear end fence.

80. The sheet processing apparatus as claimed in claim 79, wherein the moving-down amount is set variably according to number of sheets to be stapled.

81. The sheet processing apparatus as claimed in claim 69, wherein the turning-over device comprises an angle-changing device configured to change an angle of the stacking tray in such a manner that the angle of stacking tray is steeper than that for a standard discharging without folding a sheet bundle into two.

82. The sheet processing apparatus as claimed in claim 81, wherein the angle changing device comprises an auxiliary tray configured to rise from the stacking tray with a predetermined position of the stacking tray as a fulcrum.

83. The sheet processing apparatus as claimed in claim 82, wherein the predetermined position is set in a range of 40 mm to 10 mm from the lowest end position of sheet bundle stacking face of stacking tray.

84. The sheet processing apparatus as claimed in claim 70, wherein a protruding amount when the protruding member protrudes is set to a distance approximately equivalent to a distance between the fulcrum of auxiliary tray rising from the stacking tray with the predetermined position on the stacking tray as the fulcrum, and the lowest end position of sheet bundle stacking face of stacking tray.

85. The sheet processing apparatus as claimed in claim 70, wherein a protruding amount of the pressing member decreases according to an increase of stacked number of sheet bundles stacked on the stacking tray.

86. The sheet processing apparatus as claimed in claim 70, wherein a protruding amount when the protruding member protrudes is variably set to a stapled sheet number.

87. The sheet processing apparatus as claimed in claim 70, wherein the pressing member is configured to presses a predetermined range symmetrical about a center of sheet bundles.

88. The sheet processing apparatus as claimed in claim 70, wherein multiple pressing members are provided to press positions symmetrical about a center of sheet bundles.

89. The sheet processing apparatus as claimed in claim 70, wherein a coefficient of friction on a top face is set to higher than that on a bottom face of the pressing member.

90. The sheet processing apparatus as claimed in claim 70, wherein a roller rotational, when the pressing member is protruding, is provided on a tip of the pressing member.

91. A sheet processing apparatus comprising:

a center-stapling device configured to staple the center of a sheet bundle made up of sheets conveyed from a sheet output apparatus;

a center-folding device configured to fold the stapled sheet bundle into two;

a discharging device configured to discharge the sheet bundle folded into two in such a manner that the side folded into two is discharged first;

a stacking tray configured to stack the sheet bundle discharged from the discharging device;

a lifting device configured to lift up/down the stacking tray;

a stacking tray driving control device configured to control driving of the lifting device, and moving the stacking tray from a standard discharging position for discharging a sheet bundle without folding into two to a predetermined lower position shorter than a sheet bundle conveying distance when a mode for discharging a sheet bundle folded into two is selected; and a guide device configured to deflect downward a front end of a sheet bundle folded into two after being discharged from the discharging device, wherein the guide device is configured to lead the front end of sheet bundle folded into two to the stacking tray or a top face of stacked sheet bundles to make them in contact with each other, the discharging device maintains the discharging action to turn over the sheet bundle, and the sheet bundle is placed on the sheet upper side stacking tray.

92. The sheet processing apparatus as claimed in claim 91, further comprising a turning-over device having a member configured to push a part at least closer to a rear end than to the front end of a sheet bundle to push out a non-stapled side toward a downstream side in a discharging direction when the front end on the side folded into two of the sheet bundle comes in contact with the stacking tray or a top sheet face of sheet bundles stacked on the stacking tray.

93. An image forming system comprising:

an image forming apparatus including an image forming device configured to form an image based on provided image data, and an input device configured to allow a user to select at least the center-stapling mode for stapling a sheet bundle at the center, and the center-folding mode for folding a sheet bundle at the center into two;

a sheet processing apparatus described in claim 49, which uses the turning-over device to turn over a sheet bundle, and stacks the sheet bundle on the stacking tray when the both center-stapling mode and the center-folding mode are set from the image forming apparatus;

a first controller configured to for control individual parts of the sheet processing apparatus; and a second controller configured to mutually communicating with the first controller, sending control information to the first controller, and controlling individual parts of the image forming apparatus, wherein a process is applied to the sheet bundle made up of sheets discharged from the image forming apparatus.

94. An image forming system comprising;

an image forming apparatus including an image forming device configured to form an image based on provided image data, and an input device configured to allow a user to select at least the center-stapling mode for stapling a sheet bundle at the center, and the center-folding mode for folding a sheet bundle at the center into two;

a sheet processing apparatus described in claim 66, which moves down the stacking tray for stacking discharged sheet to the predetermined position lower than the position where the pressing plate is provided for pressing sheet bundles stacked on the stacking tray on the aligning end side, uses the turning-over device set on the sheet processing apparatus to turn over a sheet bundle, and to stack the sheet bundle on the stacking tray, and presses the sheet bundles on the stapled side between the pressing plate and the stacking tray when both center-stapling mode and center-folding mode are set from the image forming apparatus;

a first controller configured to controller individual parts of the sheet processing apparatus; and a second controller configured to mutually communicating with the first controller, sending control information to the first controller, and controlling individual parts of the image forming apparatus, wherein a predetermined process is applied to the sheet bundle made up of sheets discharged from the image forming apparatus.

* * * * *